US008212463B2

(12) United States Patent
Sakayanagi et al.

(10) Patent No.: US 8,212,463 B2
(45) Date of Patent: Jul. 3, 2012

(54) SPARK PLUG AND ITS MANUFACTURING METHOD

(75) Inventors: Nobuaki Sakayanagi, Toyohashi (JP); Katsutoshi Nakayama, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/170,291

(22) Filed: Jun. 28, 2011

(65) Prior Publication Data

US 2012/0001533 A1 Jan. 5, 2012

(30) Foreign Application Priority Data

Jul. 2, 2010 (JP) ..... 2010-151560

(51) Int. Cl.
*H01T 1/22* (2006.01)
*H01T 21/02* (2006.01)

(52) U.S. Cl. ..... 313/141; 445/7; 313/118

(58) Field of Classification Search ..... 313/140, 313/141, 118; 445/7
See application file for complete search history.

(56) References Cited

FOREIGN PATENT DOCUMENTS

| | | |
|---|---|---|
| JP | 2003-017214 | 1/2003 |
| JP | 2006-236906 | 9/2006 |

*Primary Examiner* — Joseph L Williams
(74) *Attorney, Agent, or Firm* — Leason Ellis LLP.

(57) ABSTRACT

A spark plug includes an insulator, a center electrode, a metal shell, a ground electrode, and a noble metal tip joined to at least one of the two electrodes. The noble metal tip is joined to the electrode via a melt portion formed by using a laser or electron beam from a side surface of the noble metal tip. In a predetermined section, including a central axis of the noble metal tip, ¾ or more of one end face of the noble metal tip is joined to the electrode. When the thickness of the melt portion is taken to be TX (mm), and the length in a direction of irradiation with the laser beam is taken to be LX (mm), TX and LX satisfy $1.5 \leqq LX/TX$, and an angle $\alpha X$ or angle $\alpha Y$, formed by two predetermined straight lines, satisfies $-15 \leqq \alpha X\ (\alpha Y) \leqq 25$.

10 Claims, 19 Drawing Sheets

SPARK PLUG AND ITS MANUFACTURING METHOD

CROSS REFERENCE TO THE RELATED APPLICATIONS

This application claims the benefit of Japanese Patent Application No. 2010-151560, filed Jul. 2, 2010, which is incorporated entirely by reference herein.

FIELD OF THE INVENTION

The present invention relates to a spark plug used in an internal combustion engine, or the like, and a manufacturing method thereof.

BACKGROUND OF THE INVENTION

A spark plug used in a combustion device such as an internal combustion engine includes, for example, a center electrode extending in an axial direction, an insulating body provided on the outer periphery of the center electrode, a cylindrical metal shell mounted on the outer side of the insulating body, and a ground electrode whose proximal end portion is joined to the leading end portion of the metal shell. The ground electrode is disposed with an approximately intermediate portion thereof bent back in such a way that the leading end portion thereof is opposed to the leading end portion of the center electrode, thereby forming a spark discharge gap between the leading end portion of the center electrode and the leading end portion of the ground electrode.

Also, in recent years, a technology has been known whereby a noble metal tip is provided in a region of the leading end portion of the center electrode or ground electrode which forms the spark discharge gap, thus improving wear resistance. A laser welding using a YAG laser is commonly used in joining the noble metal tip and the ground electrode or the like (for example, refer to Patent Japanese Patent Application Laid-Open (kokai) No. 2003-17214). That is, the outer periphery of the boundary portion between the noble metal tip and the ground electrode or the like is intermittently irradiated with a laser beam to form a melt portion wherein their individual components melt together, thereby joining the noble metal tip and the ground electrode or the like.

SUMMARY OF THE INVENTION

Problems that the Invention is to Solve

However, it is necessary to increase irradiation energy in order to cause the melt portion to thrust deeper into the inner side of the ground electrode or the like so as to maintain sufficient joint strength, but when using the YAG laser, the volume of the melt portion becomes comparatively large on the outer peripheral surface (irradiated surface) side. For this reason, there is fear that the outer peripheral surface side of the melt portion is exposed to the spark discharge gap side, or the noble metal tip becomes extremely thin-walled on the outer peripheral surface side. As a result of this, there is fear that the working effect of wear resistance being improved by providing the noble metal tip is not sufficiently achieved.

Problems that the Invention is to Solve

As opposed to this, it is conceivable that the irradiation energy of the laser beam is reduced, thereby reducing the volume of the melt portion, thus preventing the exposure of the melt portion to the spark discharge gap side. However, the reduction of the melt portion brings about a decrease in the joint strength between the noble metal tip and the ground electrode or the like. This leads to an oxidized scale growth in the boundary portion between the noble metal tip and melt portion, as a result of which there is fear that a situation of the noble metal tip dropping off occurs.

It is also conceivable that the exposure of the melt portion to the spark discharge gap side is prevented by increasing the wall thickness of the noble metal tip. However, as a noble metal alloy configuring the noble metal tip is expensive, in the event that the wall thickness of the noble metal tip is increased, there is fear that manufacturing cost increases greatly. The situation is rather that it is sought to reduce the wall thickness of the noble metal tip in order to suppress manufacturing cost.

The invention, having been contrived bearing in mind the heretofore described circumstances, has an object of providing a spark plug and manufacturing method thereof with which it is possible to prevent a noble metal tip dropping off, as well as improve wear resistance, while suppressing an increase in manufacturing cost.

Means for Solving the Problems

Hereafter, an itemized description will be given of each configuration suitable for achieving the object. Working effects specific to the corresponding configurations are quoted as necessary.

Configuration 1. A spark plug of this configuration is characterized by including a cylindrical insulating body having an axial hole extending in an axial direction;

a center electrode inserted in the axial hole;

a cylindrical metal shell provided on the outer periphery of the insulating body;

a ground electrode disposed at the leading end portion of the metal shell; and a columnar noble metal tip of which one end face is joined to the leading end portion of the ground electrode, and the other end face forms a gap with the leading end portion of the center electrode, wherein the noble metal tip is joined to the ground electrode via a melt portion, wherein the noble metal tip and ground electrode melt together, formed by being irradiated with a laser beam or electron beam from a side surface side of the noble metal tip, and the melt portion, including an exposed surface which, being a region on the side irradiated with the laser beam or electron beam, is exposed on a surface of the ground electrode, is such that in a section including a central axis of the noble metal tip and perpendicular to a side surface of the ground electrode on the side irradiated with the laser beam or electron beam, ¾ or more of the one end face of the noble metal tip being joined to the ground electrode and, when the thickness of a thickest portion of the melt portion in a direction of the central axis of the noble metal tip is taken to be TX (mm), and the length of a longest portion of the melt portion in a direction of irradiation with the laser beam or electron beam is taken to be LX (mm), TX and LX satisfy $1.5 \leqq LX/TX$, and when a first straight line is drawn passing through a point AX, on the boundary between the melt portion and noble metal tip, positioned between the external line of one side surface of the noble metal tip positioned on the exposed surface side and the central axis of the noble metal tip, and a point BX thereon positioned between the external line of the other side surface of the noble metal tip and the central axis of the noble metal tip, a second straight line is drawn passing through the point BX and extending along the external line of the other end face of the noble metal tip, and an acute angle αX (°) among angles formed by the first straight line and second straight line is taken to be positive when formed on the noble metal tip side, and taken to be negative when formed on the ground electrode side, with the second straight line as a reference, the angle αX satisfies $-15 \leqq \alpha X \leqq 25$.

"A section perpendicular to a side surface of the ground electrode on the side irradiated with the laser beam or electron beam" means a section parallel to the direction of irradiation with the laser beam or the like.

According to the configuration 1, in the section including the central axis of the noble metal tip and parallel to the direction of irradiation with the laser beam or the like, ¾ or more of the one end face (bottom surface) of the noble metal tip is joined to the ground electrode. That is, the sufficiently wide melt portion is interposed between the one end face of the noble metal tip and the ground electrode. Consequently, a difference in thermal stress between the noble metal tip and ground electrode occurring along with a thermal expansion can be more reliably absorbed by the melt portion, and it is possible to suppress an oxidized scale growth in the boundary portion between the noble metal tip and ground electrode and the melt portion. As a result of this, it is possible to more reliably prevent the noble metal tip dropping off.

On the other hand, by forming the wide melt portion, there is fear that particularly the region (exposed surface side region) of the melt portion on the side irradiated with the laser beam or the like increases in volume, but according to the configuration 1, a configuration is such that the thickness TX (mm) of the thickest portion of the melt portion and the length LX (mm) of the longest portion of the melt portion satisfy 1.5 LX/TX. Consequently, even when the heretofore described kind of wide melt portion is formed, it is possible to keep the thickness of the melt portion to a sufficiently small size, and furthermore, it is possible to make the volume of the melt portion comparatively small. Because of this, it is possible to reduce a portion of the noble metal tip which melts when joined, and even when a comparatively thin one is used as the noble metal tip in order to suppress an increase in manufacturing cost, it is possible to provide the noble metal tip with a sufficient thickness after the bonding.

Furthermore, according to the configuration 1, a configuration is such that the acute angle αX (°) among the angles formed by the first straight line and second straight line satisfies $-15 \leqq \alpha X \leqq 25$, that is, the inclination of a region of the melt portion in contact with the central portion of the one end face of the noble metal tip with respect to the other end face of the noble metal tip is comparatively small. With this kind of configuration, it is possible to more reliably prevent a form being assumed in which the leading end portion (a side opposite to that of the region irradiated with the laser beam or the like) and exposed surface side region of the melt portion thrust excessively into the noble metal tip, in other words, to prevent an excessively thin-walled portion being formed in the noble metal tip. As a result of this, it is possible to effectively prevent a situation in which the melt portion inferior in wear resistance to the noble metal tip is exposed to the gap side in the initial stage of wear of the noble metal tip (a stage in which the noble metal tip superior in durability exists sufficiently).

As heretofore described, according to the configuration 1, by satisfying $1.5 \leqq LX/TX$ and $-15 \leqq \alpha X \leqq 25$, even when using a comparatively thin-walled noble metal tip, as well as it being possible to sufficiently maintain the thickness of the noble metal tip after a welding, it is possible to effectively suppress the exposure of the noble metal tip to the gap side in the initial stage of wear. As a result of this, it is possible to dramatically improve wear resistance while suppressing manufacturing cost.

Configuration 2. According to this configuration, the spark plug according to the configuration 1 is characterized in that the whole region of the one end face of the noble metal tip being joined to the ground electrode and, in the section including the central axis of the noble metal tip and perpendicular to the side surface of the ground electrode on the side irradiated with the laser beam or electron beam, when a third straight line is drawn passing through a point CX, on the boundary between the melt portion and noble metal tip, intersecting the external line of the one side surface of the noble metal tip and a point DX thereon intersecting the external line of the other side surface of the noble metal tip, a fourth straight line is drawn passing through the point DX and extending along the external line of the other end face of the noble metal tip, and an acute angle βX (°) among angles formed by the third straight line and fourth straight line is taken to be positive when formed on the noble metal tip side, and taken to be negative when formed on the ground electrode side, with the fourth straight line as a reference, the angle βX satisfies $-15 \leqq \beta X \leqq 25$.

According to the configuration 2, as the whole region of the one end face of the noble metal tip is joined to the ground electrode, the difference in thermal stress between the noble metal tip and ground electrode can be still more reliably absorbed by the melt portion. As a result of this, it is possible to more effectively suppress the oxidized scale growth in the boundary portion between the noble metal tip and the like and the melt portion, and it is possible to still more reliably prevent the noble metal tip dropping off.

Also, according to the configuration 2, a configuration is such that the acute angle βX (°) among the angles formed by the third straight line and fourth straight line satisfies $-15 \leqq \beta X \leqq 25$, that is, the other end face of the noble metal tip and a region of the melt portion in contact with the noble metal tip are approximately parallel. Consequently, it is possible to prevent a thin-walled portion being formed in one portion of the noble metal tip, and it is possible to more effectively suppress the exposure of the melt portion to the gap side accompanying the wear of the noble metal tip. As a result of this, it is possible to further improve wear resistance.

Configuration 3. According to this configuration, the spark plug according to the configuration 2 is characterized in that an acute angle γX, among angles formed by the first straight line and third straight line, is taken to be 15° or less.

According to the configuration 3, the acute angle γX formed by the first straight line and third straight line is taken to be 15° or less. That is, the portion of the melt portion in contact with the noble metal tip is made approximately flat, and a configuration is such that the thrust of the melt portion into the noble metal tip is suppressed as much as possible. Consequently, it is possible to further suppress the exposure of the melt portion to the gap side when the noble metal tip wears, and it is possible to further improve wear resistance.

Configuration 4. A spark plug manufacturing method of this configuration, being a manufacturing method of the spark plug according to any one of the configurations 1 to 3, is characterized by including:

a bonding step of joining the noble metal tip to the ground electrode by their being irradiated with a laser beam or electron beam to form the melt portion; and a cutting step of cutting the melt portion and ground electrode on the side irradiated with the laser beam or electron beam after the bonding step.

According to the configuration 4, when the laser beam or the like is caused to radiate from the ground electrode leading end face side in the cutting step, it is possible to reduce the amount of the ground electrode leading end portion protruding with respect to the noble metal tip, and when the laser beam or the like is caused to radiate from a side surface side adjacent to the ground electrode leading end face, it is possible to reduce the width of the ground electrode. Consequently, with a manufactured spark plug, it is possible to suppress a flame kernel growth inhibition caused by the ground electrode as much as possible, and it is possible to improve ignitability, Configuration 5. According to this configuration, the spark plug manufacturing method according to the configuration 4 is characterized in that in the cutting step, the melt portion, ground electrode, and noble metal tip are cut on the side irradiated with the laser beam or electron beam.

According to the configuration 5, as the noble metal tip, in addition to the melt portion and ground electrode, is also cut in the cutting step, it is possible to further reduce the amount of the ground electrode protruding with respect to the leading end portion of the noble metal tip and the width of the ground electrode. As a result of this, it is possible to further improve ignitability.

Also, although the melt portion becomes comparatively thick, and the noble metal tip becomes comparatively thin, on the side irradiated with the laser beam or the like, according to the configuration 5, it is possible to remove a comparatively thin-walled region of the noble metal tip in the cutting step. Because of this, it is possible to reduce the angle $\alpha X$ of the configuration 1 and the angle $\beta X$ of the configuration 2 closer to 0° (that is, to make the region of the melt portion in contact with the noble metal tip more nearly parallel to the other end face of the noble metal tip). Consequently, it is possible to make the thickness of the noble metal tip approximately uniform as a whole, and it is possible to further suppress the exposure of the melt portion to the gap side. As a result of this, with a manufactured spark plug, it is possible to still further improve wear resistance.

Configuration 6. A spark plug of this configuration is characterized by including a cylindrical insulating body having an axial hole extending in an axial direction;

a center electrode inserted in the axial hole;

a cylindrical metal shell provided on the outer periphery of the insulating body; and a columnar noble metal tip of which one end face is joined to the leading end portion of the center electrode, wherein the noble metal tip is joined to the center electrode via a melt portion, wherein the noble metal tip and center electrode melt together, formed by being irradiated with a laser beam or electron beam from a side surface side of the noble metal tip, and the melt portion, including an exposed surface which, being a region on the side irradiated with the laser beam or electron beam, is exposed on a surface of the center electrode, is such that in a section including a central axis of the noble metal tip and passing through the center of the exposed surface, ¾ or more of the one end face of the noble metal tip being joined to the center electrode and, when the thickness of a thickest portion of the melt portion in a direction of the central axis of the noble metal tip is taken to be TY (mm), and the length of a longest portion of the melt portion in a direction of irradiation with the laser beam or electron beam is taken to be LY (mm), TY and LY satisfy $1.5 \leqq LY/TY$, and when a fifth straight line is drawn passing through a point AY, on the boundary between the melt portion and noble metal tip, positioned between the external line of one side surface of the noble metal tip positioned on the exposed surface side and the central axis of the noble metal tip, and a point BY thereon positioned between the external line of the other side surface of the noble metal tip and the central axis of the noble metal tip, a sixth straight line is drawn passing through the point BY and extending along the external line of the other end face of the noble metal tip, and an acute angle $\alpha Y$ (°) among angles formed by the fifth straight line and sixth straight line is taken to be positive when formed on the noble metal tip side, and taken to be negative when formed on the center electrode side, with the sixth straight line as a reference, the angle $\alpha Y$ satisfies $-15 \leqq \alpha Y \leqq 25$.

According to the configuration 6, working effects the same as the working effects achieved in the configuration 1 are achieved in a relationship between the center electrode and the noble metal tip joined thereto. That is, it is possible to dramatically improve wear resistance while more reliably suppressing a detachment of the noble metal tip joined to the center electrode.

The spark plug may be configured in such a way as to satisfy both the configuration 1 and configuration 6. In this case, it is possible to still further suppress an increase in the gap accompanying a spark discharge, enabling a spark discharge over a longer period.

Configuration 7. According to this configuration, the spark plug according to the configuration 6 is characterized in that the whole region of the one end face of the noble metal tip being joined to the center electrode and, in the section including the central axis of the noble metal tip and passing through the center of the exposed surface, when a seventh straight line is drawn passing through a point CY, on the boundary between the melt portion and noble metal tip, intersecting the external line of the one side surface of the noble metal tip and a point DY thereon intersecting the external line of the other side surface of the noble metal tip, an eighth straight line is drawn passing through the point DY and extending along the other end face of the noble metal tip, and an acute angle $\beta Y$ (°) among angles formed by the seventh straight line and eighth straight line is taken to be positive when formed on the noble metal tip side, and taken to be negative when formed on the center electrode side, with the eighth straight line as a reference, the angle $\beta Y$ satisfies $-15 \beta Y \leqq 25$.

According to the configuration 7, working effects the same as the working effects achieved by the configuration 2 are achieved in a relationship between the center electrode and the noble metal tip joined thereto.

Configuration 8. According to this configuration, the spark plug according to the configuration 7 is characterized in that an acute angle γY, among angles formed by the fifth straight line and seventh straight line, is taken to be 15° or less.

According to the configuration 8, working effects the same as the working effects achieved by the configuration 3 are achieved in a relationship between the center electrode and the noble metal tip joined thereto.

DETAILED DESCRIPTION OF THE INVENTION

Modes for Carrying Out the Invention

Figure 1:
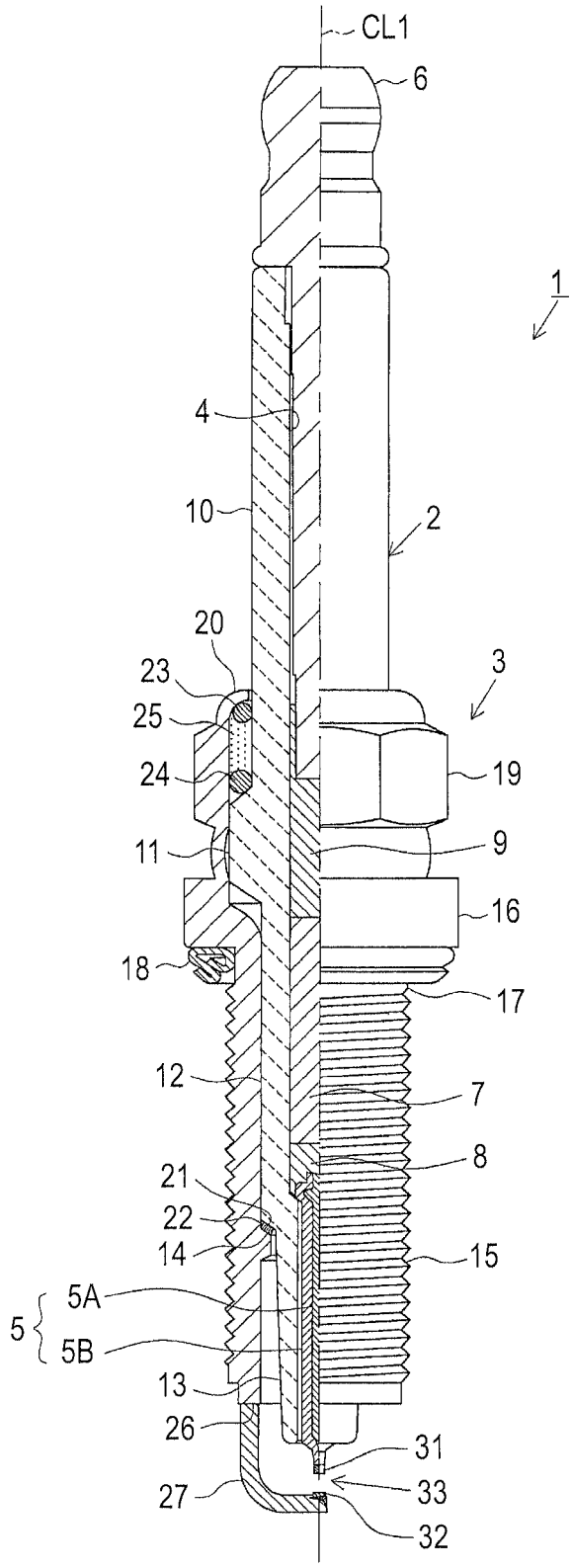
FIG. 1 is a partially sectioned front view showing a configuration of a spark plug.

Hereafter, referring to the drawings, a description will be given of embodiments.

[First Embodiment]

FIG. 1 is a partially sectioned front view showing a spark plug 1. In FIG. 1, a description will be given with a direction of an axis CL1 of the spark plug 1 as an up-down direction in the drawing, the lower side as a leading end side of the spark plug 1, and the upper side as a rear end side.

The spark plug 1 is configured of an insulator 2 acting as a cylindrical insulating body, a cylindrical metal shell 3 which holds the insulator 2, and the like.

The insulator 2, being formed by calcining alumina or the like, as is well known, includes in the external portion thereof a rear end side barrel portion 10 formed on the rear end side, a large diameter portion 11 formed closer to the leading end side than the rear end side barrel portion 10 so as to protrude outward in a radial direction, a middle barrel portion 12 formed closer to the leading end side than the large diameter portion 11 so as to be smaller in diameter than the large diameter portion 11, and a leg length portion 13 formed closer to the leading end side than the middle barrel portion 12 so as to be smaller in diameter than the middle barrel portion 12. In addition, the large diameter portion 11, the middle barrel portion 12, and the larger proportion of the leg length portion 13, of the insulator 2 are housed inside the metal shell 3. Then, a tapered shoulder 14 is formed at the bonding of the middle barrel portion 12 and leg length portion 13, and the insulator 2 is retained on the metal shell 3 by the shoulder 14.

Furthermore, an axial hole 4 is formed in the insulator 2 along the axis CL1 so as to pass through the insulator 2, and a center electrode 5 is inserted and fixed on the leading end side of the axial hole 4. The center electrode 5 is configured of an inner layer 5A formed from superior thermally conductive copper or copper alloy and an outer layer 5B formed from an Ni alloy with nickel (Ni) as a primary component. Furthermore, the center electrode 5 is formed in a bar-like (cylindrical) shape as a whole, and the leading end face thereof, as well as being formed to be flat, protrudes from the leading end of the insulator 2. Also, a cylindrical noble metal portion 31 formed from a predetermined noble metal alloy (for example, a platinum alloy or an iridium alloy) is provided at the leading end portion of the center electrode 5.

Also, a terminal electrode 6 is inserted and fixed on the rear end side of the axial hole 4 in a condition in which it protrudes from the rear end of the insulator 2.

Furthermore, a cylindrical resistor 7 is disposed between the center electrode 5 and terminal electrode 6 in the axial hole 4. Both end portions of the resistor 7 are electrically connected to the center electrode 5 and terminal electrode 6 via conductive glass seal layers 8 and 9 respectively.

In addition, the metal shell 3 is formed in a cylindrical shape from a metal such as a low carbon steel, and a thread portion (a male thread portion) 15 for mounting the spark plug 1 in a mounting hole of a combustion device (for example, an internal combustion engine or a fuel cell reformer) is formed on the outer peripheral surface of the metal shell 3. Also, a seat 16 is formed on the rear side outer peripheral surface of the thread portion 15, and a ring-like gasket 18 is fitted with a thread neck 17 at the rear end of the thread portion 15. Furthermore, a tool engagement portion 19 of hexagonal cross section for engaging a tool such as a wrench when mounting the metal shell 3 in the combustion device is provided, as well as a caulked portion 20 for holding the insulator 2 at the rear end portion being provided, on the rear end side of the metal shell 3.

Also, a tapered shoulder 21 for retaining the insulator 2 is provided on the inner peripheral surface of the metal shell 3. Then, the insulator 2 is inserted from the rear end side toward the leading end side of the metal shell 3, and fixed by caulking a rear end side opening portion of the metal shell 3 inward in the radial direction, that is, forming the caulked portion 20, in a condition in which the shoulder 14 of the insulator 2 is retained in the shoulder 21 of the metal shell 3. An annular plate packing 22 is interposed between the shoulders 14 and 21 of both the insulator 2 and metal shell 3. By so doing, a configuration is such that the interior of a combustion chamber is maintained airtight, thus preventing a fuel gas infiltrating a space between the insulator 2 leg length portion 13 and metal shell 3 inner peripheral surface exposed to the interior of the combustion chamber from leaking to the exterior.

Furthermore, in order to make a caulking seal more complete, annular ring members 23 and 24 are interposed between the metal shell 3 and insulator 2 on the rear end side of the metal shell 3, and a space between the ring members 23 and 24 is filled with talc 25 powder. That is, the metal shell 3 holds the insulator 2 via the plate packing 22, ring members 23 and 24, and talc 25.

Figure 2:
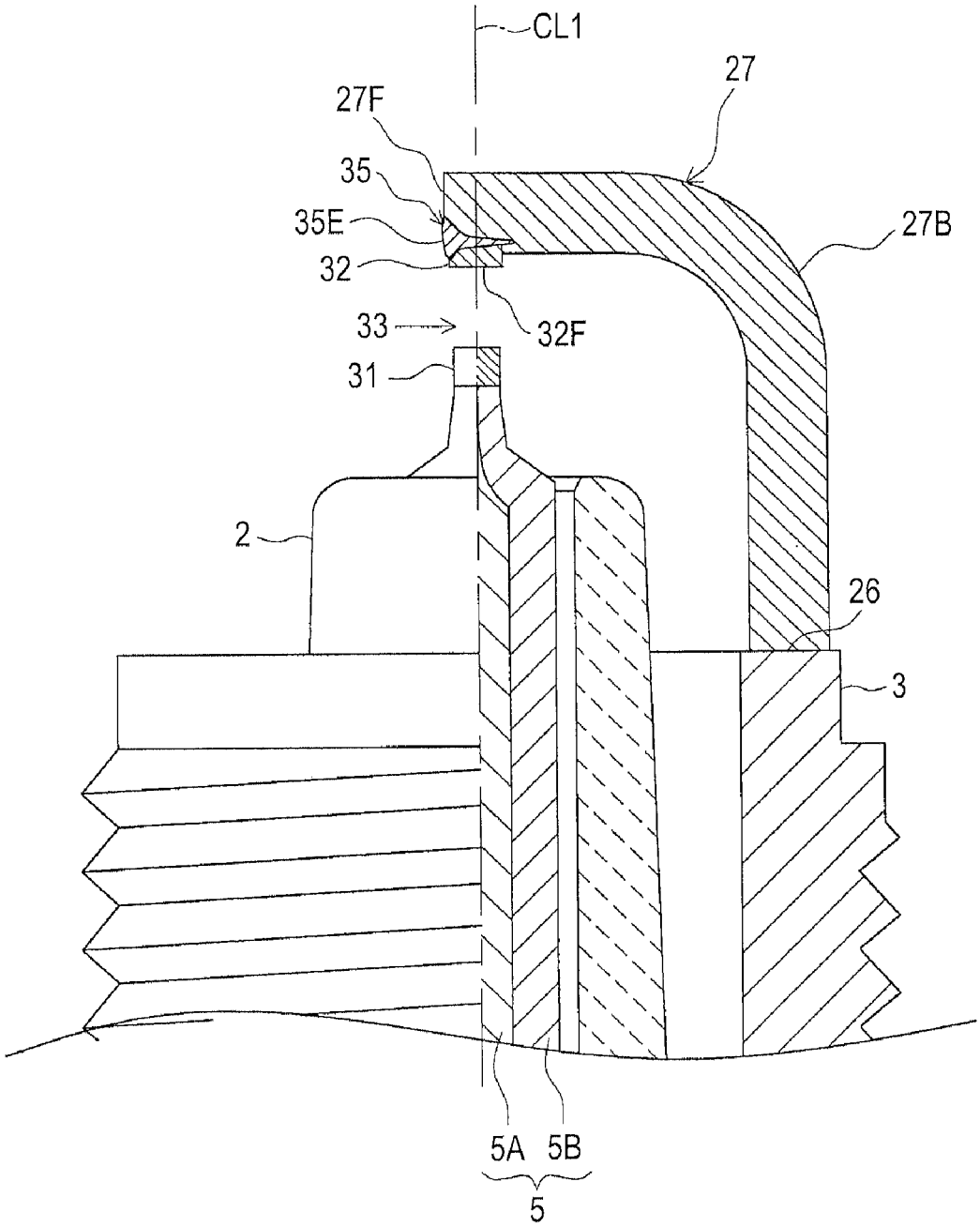
FIG. 2 is a partially sectioned enlarged front view showing a configuration of the leading end portion of the spark plug.

Also, as shown in FIG. 2, a bar-like ground electrode 27 bent back in a bent portion 27B positioned in an approximately intermediate portion, the leading end portion of which is opposed to the leading end portion (noble metal portion 31) of the center electrode 5, is joined to a leading end portion 26 of the metal shell 3. The ground electrode 27 is configured of an Ni alloy with Ni as a primary component (for example, an alloy containing silicon, aluminum, and at least one kind of rare earth element with Ni as a primary component).

Also, one end face of a cylindrical noble metal tip 32 is joined to a region of the ground electrode 27 opposed to the noble metal portion 31. The noble metal tip 32 is configured of a predetermined noble metal alloy (for example, a noble metal alloy containing at least one kind among iridium, platinum, rhodium, ruthenium, palladium, and rhenium). In the embodiment, the noble metal tip 32 is such that the wall thickness is made comparatively small (for example, 0.3 mm or more and 0.6 mm or less) in order to suppress manufacturing cost, while the area of another end face (a discharge surface) 32F is made comparatively large (for example, $0.35^{=2}$ or more (that is, the outside diameter of the noble metal tip is taken to be 0.7 mm or more)) in order to improve wear resistance.

In addition, a spark discharge gap 33 acting as a gap is formed between the other end face 32F of the noble metal tip 32 and the noble metal portion 31, and a configuration is such that a spark discharge is carried out in a direction along the axis CL1 in the spark discharge gap 33.

Furthermore, in the embodiment, a hole portion is provided in the ground electrode 27, and the noble metal tip 32, by being welded to the ground electrode 27 after being installed in the hole portion, is joined to the ground electrode 27 in a condition in which one portion of the noble metal tip 32 is buried in the ground electrode 27. Herein, the noble metal tip 32 is joined to the ground electrode 27 via a melt portion 35, wherein the noble metal tip 32 and ground electrode 27 melt together, formed by being irradiated with a laser beam or electron beam from a side surface side of the noble metal tip 32 and a side surface (a surface adjacent to a surface to which the noble metal tip 32 is joined) side of the ground electrode 27. In the embodiment, the laser beam or electron beam is caused to radiate from a leading end face 27F side of the ground electrode 27. For this reason, the melt portion 35 includes an exposed surface 35E, which is exposed on the leading end face 27F of the ground electrode 27, in a region on the side irradiated with the laser beam or electron beam.

Figure 3:
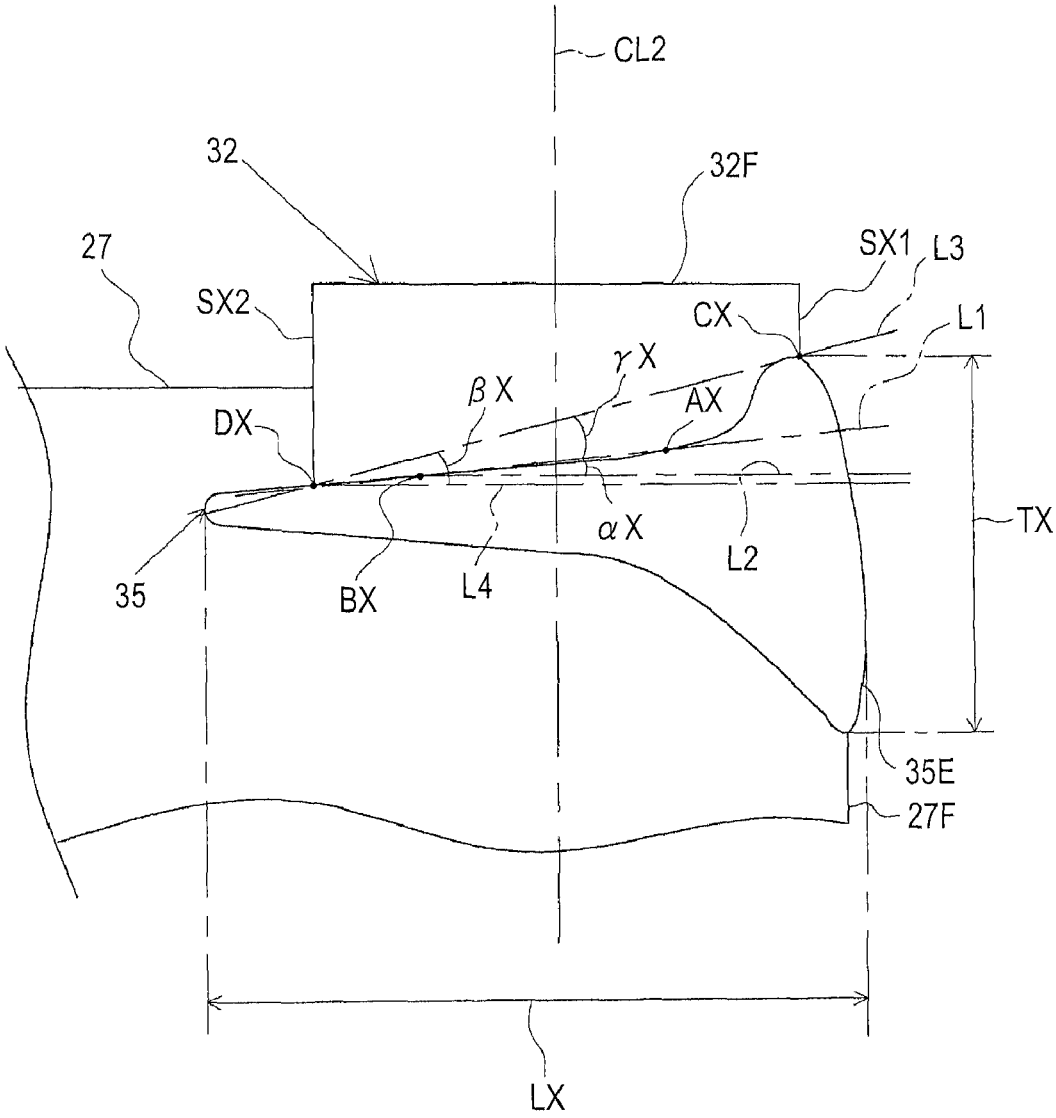
FIG. 3 is an enlarged sectional schematic view showing a configuration of a melt portion.

Furthermore, in the embodiment, as shown in FIG. 3 (in FIG. 3, hatching is omitted for ease of description), in a section which, as well as including a central axis CL2 of the noble metal tip 32, is perpendicular to a side surface of the ground electrode on the side irradiated with the laser beam or electron beam (in the embodiment, to the leading end surface 27F of the ground electrode 27), ¾ or more of the one end face (bottom surface) (in the embodiment, the whole region of the one end face) of the noble metal tip 32 is joined to the ground electrode 27 by adjusting a laser beam or electron beam power or the like.

In addition, the melt portion 35 is formed in such a way as to satisfy the following configurations. That is, in the heretofore described section, when the thickness of a thickest portion of the melt portion 35 in a direction of the central axis CL2 of the noble metal tip 32 (a distance along the central axis CL2 between a point at which the melt portion 35 thrusts deepest into the noble metal tip 32 and a point at which the melt portion 35 thrusts deepest into the ground electrode 27) is taken to be TX (mm), and the length of a longest portion of the melt portion 35 in a direction of irradiation with the laser beam or electron beam is taken to be LX (mm), a configuration is such that TX and LX satisfy $1.5 \leqq LX/TX$.

Also, a first straight line L1 is drawn passing through a point AX, on the boundary between the melt portion 35 and noble metal tip 32, positioned (centrally) between the external line of one side surface SX1 of the noble metal tip 32 positioned on the exposed surface 35E side and the central axis CL2 of the noble metal tip 32, and a point BX thereon positioned between the external line of another side surface SX2 of the noble metal tip 32 and the central axis CL2 of the noble metal tip 32, and a second straight line L2 is drawn passing through the point BX and extending along the external line of the other end face 32F of the noble metal tip 32. At this time, when an acute angle $\alpha X$ (°), among angles formed by the first straight line L1 and second straight line L2, formed on the central axis CL2 side is taken to be positive when formed on the noble metal tip 32 side, and taken to be negative when formed on the ground electrode 27 side, with the second straight line L2 as a reference, a configuration is such that the angle $\alpha X$ satisfies $-15 \leqq \alpha X \leqq 25$ (in the embodiment, $0 \leqq \alpha X \leqq 25$). That is, a configuration is such that the inclination of a region of the melt portion 35 in contact with the central portion of the one end face of the noble metal tip 32 with respect to the other end face 32F of the noble metal tip 32 is comparatively small.

Furthermore, in the heretofore described section, a third straight line L3 is drawn passing through a point CX, on the boundary between the melt portion 35 and noble metal tip 32, intersecting the external line of the one side surface SX1 of the noble metal tip 32, and a point DX thereon intersecting the external line of the other side surface SX2 of the noble metal tip 32, and a fourth straight line L4 is drawn passing through the point DX and extending along the external line of the other end face 32F of the noble metal tip 32. At this time, when an acute angle $\beta X$ (°), among angles formed by the third straight line L3 and fourth straight line L4, formed on the central axis CL2 side is taken to be positive when formed on the noble metal tip 32 side, and taken to be negative when formed on the ground electrode 27 side, with the fourth straight line L4 as a reference, a configuration is such that the angle $\beta X$ satisfies $-15 \leqq \beta X \leqq 25$ (in the embodiment, $0 \leqq \beta X \leqq 25$). That is, a configuration is such that the inclination from one end to the other end of a region of the melt portion 35 in contact with the noble metal tip 32 (an average inclination of the region of the melt portion 35 in contact with the noble metal tip 32) with respect to the other end face 32F of the noble metal tip 32 is comparatively small.

Also, when an acute angle among angles formed by the first straight line L1 and third straight line L3 is taken to be $\gamma X$ (°), a configuration is such that the angle $\gamma X$ satisfies $\gamma X \leqq 15$. That is, it is taken that the inclination of the region of the melt portion 35 in contact with the center of the one end face of the noble metal tip 32 with respect to the other end face 32F of the noble metal tip 32 and the average inclination of the region of the melt portion 35 in contact with the noble metal tip 32 with respect to the other end face 32F are approximately equal. Consequently, the region of the melt portion 35 in contact with the noble metal tip 32 is approximately flat.

Furthermore, the melt portion 35, by being formed in the heretofore described form, is prevented from being exposed on the other end face 32F of the noble metal tip 32 despite the noble metal tip 32 being comparatively thin-walled.

Next, a description will be given of a manufacturing method of the spark plug 1 configured in the way heretofore described. Firstly, the metal shell 3 is processed in advance. That is, a cylindrical metal material (for example, an iron-based material or stainless steel material) is processed by a cold forging or the like, thereby forming an outline, and forming a through hole therein. Subsequently, the external shape is arranged by performing a cutting process, obtaining a metal shell intermediate body.

Continuing, the straight bar-like ground electrode 27 formed from an Ni alloy is resistance welded to the leading end face of the metal shell intermediate body. As a so-called "sagging" occurs when resistance welding, after the "sagging" is removed, the thread portion 15 is formed in a predetermined region of the metal shell intermediate body by a thread rolling. By so doing, the metal shell 3 to which the ground electrode 27 is welded is obtained. Also, the metal shell 3 to which the ground electrode 27 is welded is plated with zinc or nickel. In order to improve corrosion resistance, a chromate treatment may be further performed on the surface thereof.

Meanwhile, apart from the metal shell 3, the insulator 2 is processed by a molding in advance. A cylindrical compact is obtained by preparing a molding green body agglomerated material using raw powder containing, for example, a binder with alumina as an agent, and carrying out a rubber press molding using the molding green body agglomerated material. Then, the obtained compact is processed by a cutting and shaped, and the shaped compact is calcined in a calcination furnace, thereby obtaining the insulator 2.

Also, apart from the metal shell 3 and insulator 2, the center electrode 5 is manufactured in advance. That is, an Ni alloy wherein a copper alloy or the like for improving heat radiation is disposed in the central portion is processed by a forging, fabricating the center electrode 5. Next, the noble metal portion 31 formed from a noble metal alloy is joined to the leading end portion of the center electrode 5 by a laser welding or the like.

Next, the insulator 2 and center electrode 5 obtained in the way heretofore described, the resistor 7, and the terminal electrode 6 are sealed and fixed by the glass seal layers 8 and 9. The glass seal layers 8 and 9 are commonly prepared with borosilicate glass and metal powder mixed therein, and the prepared mixture, after being injected into the axial hole 4 of the insulator 2 in such a way as to sandwich the resistor 7, is heated in the calcination furnace while being pressed by the terminal electrode 6 from behind, and thereby calcined firmly. At this time, it may be taken that a glazing layer is simultaneously calcined on the surface of the rear end side barrel portion 10 of the insulator 2, or it may be taken that a glazing layer is formed in advance.

Subsequently, the insulator 2 including the center electrode 5 and terminal electrode 6 each fabricated in the way heretofore described and the metal shell 3 including the ground electrode 27 are fixed. More specifically, the insulator 2 and metal shell 3 are fixed by, after inserting the insulator 2 into the metal shell 3, caulking the metal shell 3 rear end side opening portion, formed to be comparatively thin-walled, inward in the radial direction, that is, forming the caulked portion 20.

Next, the noble metal tip 32 is joined to the leading end portion of the ground electrode 27. That is, after a hole portion having an inside diameter approximately equal to the outside diameter of the noble metal tip 32 is formed in the leading end portion of the ground electrode 27, the noble metal tip 32 is placed on the bottom surface of the hole portion. Then, after the noble metal tip 32 is supported by a predetermined holding pin, the interface between the ground electrode 27 and noble metal tip 32 is irradiated with a fiber laser beam or a highly energetic laser beam, such as an electron beam, from the leading end face 27F side of the ground electrode 27 while causing a laser beam irradiation position to move in a width direction of the ground electrode 27. By so doing, the melt portion 35 is formed, and the noble metal tip 32 is joined to the ground electrode 27. A direction of irradiation with the fiber laser beam or the like is set to be an orientation parallel to the other end face 32F of the noble metal tip 32.

In addition, conditions of irradiation with the laser beam or the like are set in such a way that, as well as ¾ or more of the one end face of the noble metal tip 32 being joined to the ground electrode 27, the melt portion 35 assumes the heretofore described form. Specifically, based on the point that it is possible to make the angle $\alpha X$ and angle $\beta X$ comparatively large by reducing the processing rate (shortening the irradiation time) of the laser beam or the like, and it is possible to make the angle $\alpha X$ and angle $\beta X$ comparatively small by accelerating the processing rate, the irradiation with the laser beam or the like is carried out by making the processing rate comparatively high after making output energy comparatively high. When noble metal tip 32 outside diameters or materials configuring the noble metal tip 32 and the like differ, it is possible to form the melt portion 35 having the heretofore described configuration by appropriately adjusting the power and irradiation time of the laser beam or the like, the way of shooting the laser beam or the like (whether the laser beam is formed of a continuous wave or intermittent waves (pulses), or the like), and the like.

After the bonding of the noble metal tip 32, the approximately intermediate portion of the ground electrode 27 is bent to the center electrode 5 side, forming the bent portion 27B in the ground electrode 27. Then, the heretofore described spark plug 1 is obtained by adjusting the size of the spark discharge gap 33 between the noble metal portion 31 and noble metal tip 32.

As heretofore described in detail, according to the embodiment, in the section including the central axis CL2 of the noble metal tip 32 and extending in the direction of irradiation with the laser beam or the like, ¾ or more of the one end face (bottom surface) of the noble metal tip 32 is joined to the ground electrode 27. That is, the sufficiently wide melt portion 35 is interposed between the one end face of the noble metal tip 32 and the ground electrode 27. Consequently, a difference in thermal stress between the noble metal tip 32 and ground electrode 27 occurring along with a thermal expansion can be more reliably absorbed by the melt portion 35, and it is possible to suppress an oxidized scale growth in the boundary portion between the noble metal tip 32 and ground electrode 27 and the melt portion 35. As a result of this, it is possible to more reliably prevent the noble metal tip 32 dropping off.

Meanwhile, there is fear that particularly the region (exposed surface 35E side region) of the melt portion 35 on the side irradiated with the laser beam or the like increases in volume by forming the wide melt portion 35, but a configuration is such that the thickness TX (mm) and length LX (mm) of the melt portion 35 satisfy $1.5 \leqq LX/TX$. Consequently, even when the heretofore described kind of wide melt portion 35 is formed, it is possible to keep the thickness of the melt portion 35 to a sufficiently small size, and furthermore, it is possible to make the volume of the melt portion 35 comparatively small. Because of this, it is possible to reduce a portion of the noble metal tip 32 which melts when joined, and even when using a comparatively thin noble metal tip 32, it is possible to provide the noble metal tip 32 with a sufficient thickness after the bonding.

Furthermore, a configuration is such that the angle $\alpha X$ (°) formed by the first straight line L1 and second straight line L2 satisfies $-15 \leqq \alpha X \leqq 25$. Consequently, it is possible to more reliably prevent the leading end portion and exposed surface 35E side region of the melt portion 35 from assuming a form in which they thrust excessively into the noble metal tip 32 (in other words, an excessively thin-walled portion from being formed in the noble metal tip 32). As a result of this, it is possible, in the initial stage of wear of the noble metal tip 32, to effectively prevent a situation wherein the melt portion 35 inferior in wear resistance to the noble metal tip 32 is exposed to the spark discharge gap 33 side.

As heretofore described, according to the embodiment, by satisfying $1.5 \leqq LX/TX$ and $-15 \leqq \alpha X \leqq 25$, even when using the comparatively thin-walled noble metal tip 32, as well as it being possible to sufficiently maintain the thickness of the noble metal tip 32 after the welding, it is possible to effectively suppress the exposure of the melt portion 35 to the spark discharge gap 33 side in the initial stage of wear. As a result of this, it is possible to dramatically improve wear resistance while suppressing manufacturing cost.

Also, a configuration is such that the angle $\beta X$ (°) among the angles formed by the third straight line L3 and fourth straight line L4 satisfies $-15 \leqq \beta X \leqq 25$, and the angle $\gamma X$ among the angles formed by the first straight line L1 and third straight line L3 satisfies $\gamma X \leqq 15$. Because of this, it is possible to further suppress the exposure of the melt portion 35 to the spark discharge gap 33 side when the noble metal tip 32 wears, and it is possible to further improve wear resistance.

[Second Embodiment]

Figure 4:
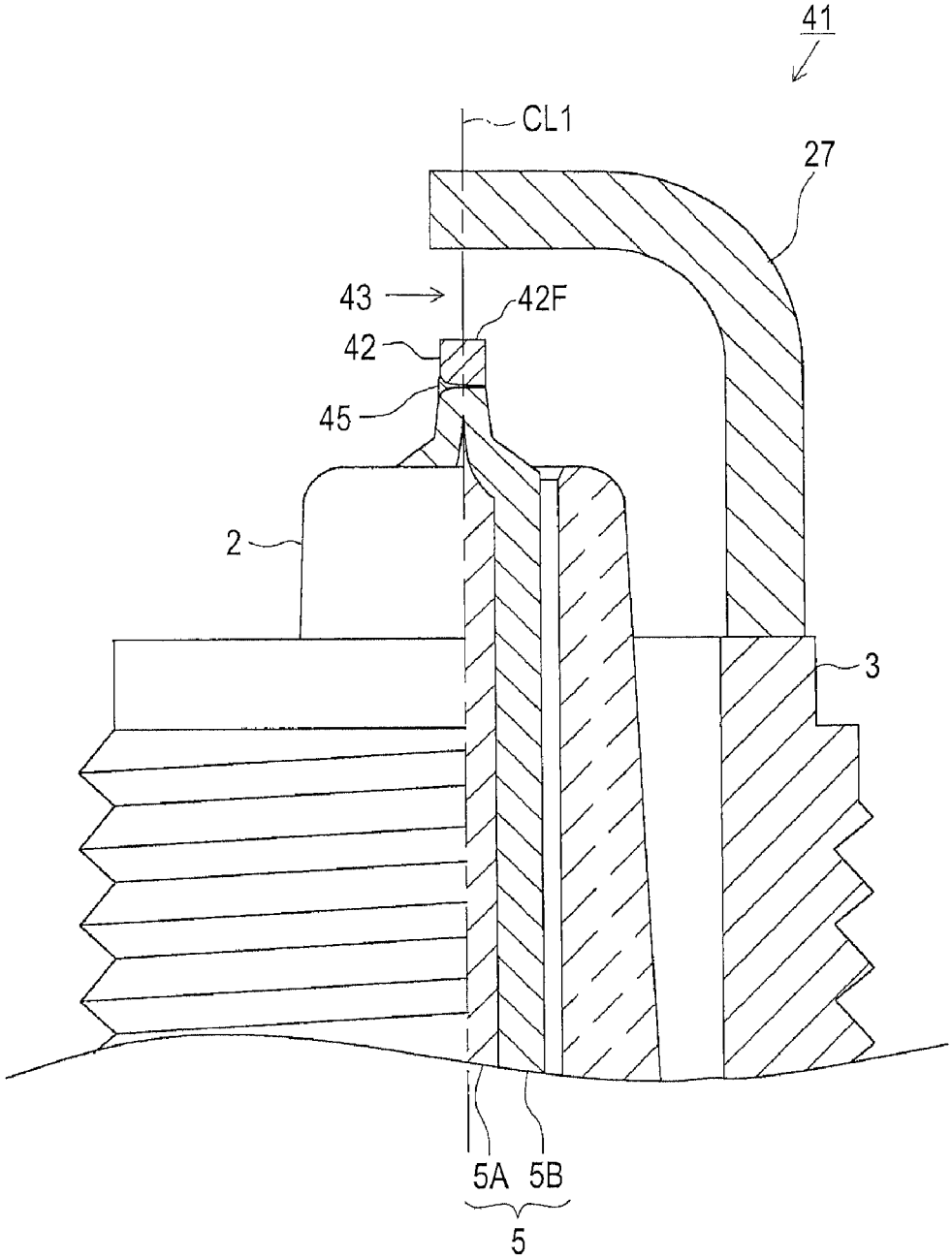
FIG. 4 is a partially sectioned enlarged front view showing a configuration of the leading end portion of a spark plug in a second embodiment.

Next, a description will be given of a second embodiment, centered on a difference from the first embodiment. As shown in FIG. 4, a spark plug 41 in the second embodiment is such that a noble metal tip 42 is joined to the leading end portion of the center electrode 5 via a melt portion 45 formed by being irradiated with the laser beam or electron beam. Meanwhile, no noble metal tip is provided on the ground electrode 27, and a spark discharge gap 43 acting as the gap is formed between the noble metal tip 42 and ground electrode 27.

Figure 5:
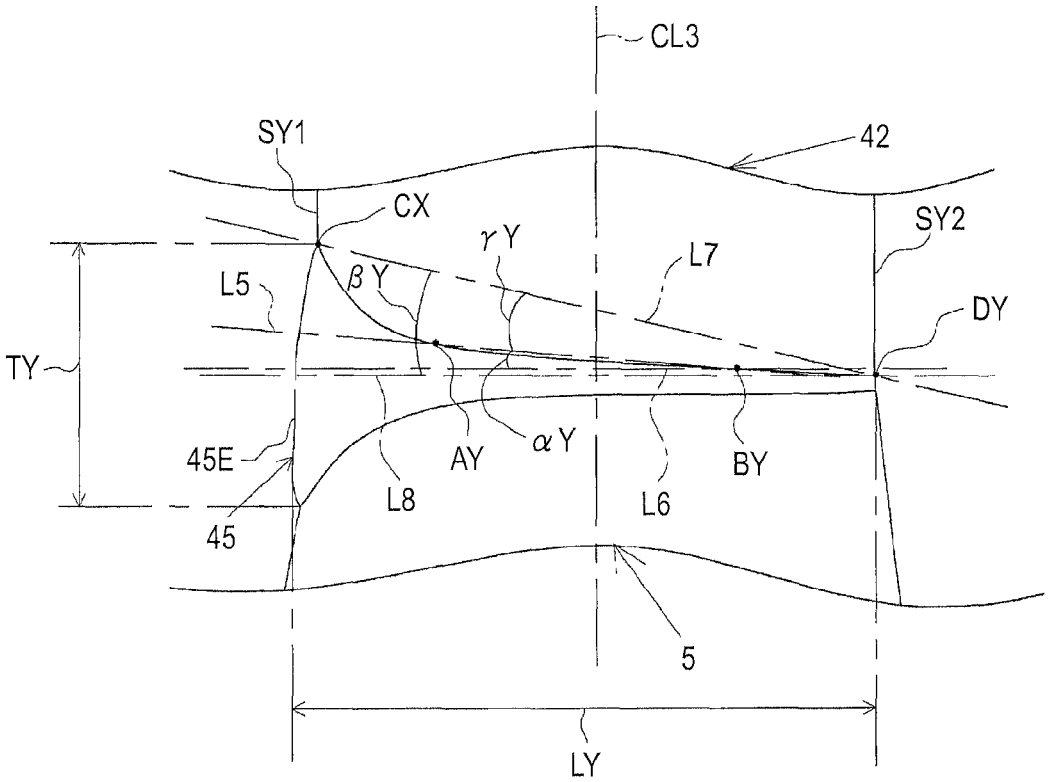
FIG. 5 is an enlarged sectional schematic view showing a configuration of a melt portion in the second embodiment

Also, the melt portion 45 is formed in such a way as to satisfy the following configurations. That is, as shown in FIG. 5 (in FIG. 5, hatching is omitted for ease of description), in a section including a central axis CL3 of the noble metal tip 42 and passing through the center of an exposed surface 45E of the melt portion 45, ¾ or more of one end surface (in the embodiment, the whole region of the one end surface) of the noble metal tip 42 is joined to the center electrode 5.

In addition, in the heretofore described section, when the thickness of a thickest portion of the melt portion 45 in a direction of the central axis CL3 of the noble metal tip 42 is taken to be TY (mm), and the length of a longest portion of the melt portion 45 in a direction of irradiation with the laser beam or electron beam is taken to be LY (mm), a configuration is such that TY and LY satisfy $1.5 \leqq LY/TY$ is.

Furthermore, a fifth straight line L5 is drawn passing through a point AY, on the boundary between the melt portion 45 and noble metal tip 42, positioned (centrally) between the external line of one side surface SY1 of the noble metal tip 42 positioned on the exposed surface 45E side and the central axis CL3 of the noble metal tip 42, and a point BY thereon positioned between the external line of another side surface SY2 of the noble metal tip 42 and the central axis CL3 of the noble metal tip 42, and a sixth straight line L6 is drawn passing through the point BY and extending along the external line of another end face 42F (refer to FIG. 4) of the noble metal tip 42. At this time, when an acute angle $\alpha Y$ (°), among angles formed by the fifth straight line L5 and sixth straight line L6, formed on the central axis CL3 side is taken to be positive when formed on the noble metal tip 42 side, and taken to be negative when formed on the center electrode 5 side, with the sixth straight line L6 as a reference, a configuration is such that the angle $\alpha Y$ satisfies $-15 \alpha Y \leqq 25$ (in the embodiment, $0 \leqq \alpha Y \leqq 25$).

Also, in the heretofore described section, a seventh straight line L7 is drawn passing through a point CY, on the boundary between the melt portion 45 and noble metal tip 42, intersecting the external line of the one side surface SY1 of the noble metal tip 42 and a point DY thereon intersecting the external line of the other side surface SY2 of the noble metal tip 42, and an eighth straight line L8 is drawn passing through the point DY and extending along the other end face 42F of the noble metal tip 42. At this time, when an acute angle $\beta Y$ (°), among angles formed by the seventh straight line L7 and eighth straight line L8, formed on the central axis CL3 side is taken to be positive when formed on the noble metal tip 42 side, and taken to be negative when formed on the center electrode 5 side, with the eighth straight line L8 as a reference, a configuration is such that the angle $\beta Y$ satisfies $-15 \leqq \beta Y \leqq 25$ (in the embodiment, $0 \leqq \beta Y \leqq 25$).

In addition, a configuration is such that an acute angle $\gamma Y$ (°) among angles formed by the fifth straight line L5 and seventh straight line L7 satisfies $\gamma Y \leqq 15$.

As heretofore described in detail, according to the second embodiment, working effects the same as the working effects achieved by the first embodiment are achieved in a relationship between the center electrode 5 and the noble metal tip 42 joined thereto. That is, with the noble metal tip 42 joined to the center electrodes, it is possible to dramatically improve wear resistance while more reliably suppressing a detachment of the noble metal tip 42.

Next, in order to confirm the working effects achieved by the heretofore described embodiments, spark plug samples wherein the melt ratio of the one end face of the noble metal tip to the ground electrode is taken to be ½, ¾, and 1 (indicating that the whole region of the one end face is joined to the ground electrode) are fabricated, and a desktop thermal test is carried out on each sample. The outline of the desktop thermal test is as follows. That is, each sample, after being heated by a burner for two minutes in such a way that the temperature of the noble metal tip reaches 950° C. in an ambient air atmosphere, is slowly cooled for one minute, and with this treatment as one cycle, 1000 cycles are implemented. By observing the sections of the samples after 1000 cycles are finished, the ratio (oxidized scale ratio) of the length of an oxidized scale formed on the interface between the melt portion and the noble metal tip and ground electrode to the length of the interface is measured. Herein, it is taken that a sample with an oxidized scale ratio of 50% or less is given a "o" evaluation as it is superior in noble metal tip detachment resistance, and a sample with an oxidized scale rate of more than 50% is given a "x" evaluation as it is inferior in detachment resistance. Results of the desktop thermal tests on the individual samples are shown in Table 1. In the following tests, the test is carried out on each sample wherein the noble metal tip is provided on the ground electrode, but it is conceivable that the same tendency also occurs when the noble metal tip is provided on the center electrode. Also, a noble metal tip with an outside diameter of 0.9 mm and a thickness of 0.4 mm before the welding is used for each sample.

TABLE 1

| Melt ratio | Oxidized scale ratio (%) | Evaluation |
|---|---|---|
| ½ | 55 | x |
| ¾ | 30 | ○ |
| 1 (whole region welded) | 0 | ○ |

As shown in Table 1, with the sample having a melt ratio of ½, the oxidized scale ratio is more than 50%, and it is revealed that the sample is inferior in noble metal tip detachment resistance. It is conceivable that this is because, as the melt portion is comparatively narrow, it is not possible to sufficiently absorb the difference in thermal stress occurring between the noble metal tip and ground electrode, as a result of which it is not possible to sufficiently prevent the oxidized scale growth.

As opposed to this, with the sample having a melt ratio of ¾, the oxidized scale ratio is 30% or less, and it is revealed that it is possible to realize superior detachment resistance. It is conceivable that this is because the difference in thermal stress between the noble metal tip and ground electrode can be sufficiently absorbed by a comparatively wide melt portion. Also, particularly with the sample having a melt ratio of 1, the oxidized scale ratio is 0%, and it is confirmed that the sample is very superior in detachment resistance.

It can be said from the above test results that, in order to improve noble metal tip detachment resistance, it is preferable to take the metal ratio of the one end face of the noble metal tip to the ground electrode to be ¾ or more, and it is more preferable to take the melt ratio to be 1.

Figure 6:
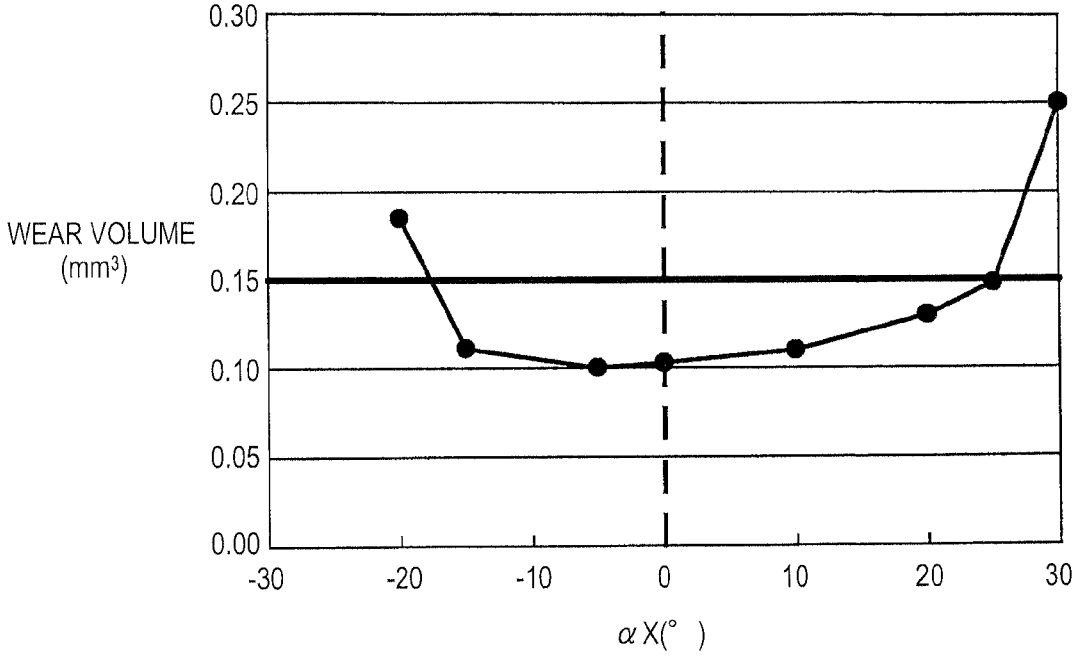
FIG. 6 is a graph showing a relationship between an angle αX and wear volume in a desktop spark test.

Next, spark plug samples are fabricated wherein the angle $\alpha X$ (°) formed by the first straight line and second straight line is variously changed by changing the irradiation angle while taking the processing rate to be 20 mm/sec to 70 mm/sec after fixing the power of the laser beam to 300 W, and the desktop spark test is carried out on each sample. The outline of the desktop spark test is as follows. That is, after each sample and a power supply are connected in such a way that a spark discharge occurs by taking the center electrode to be positive and the ground electrode to be negative, each sample is discharged for 400 hours in an ambient air atmosphere of 0.4 MPa with the frequency of a voltage applied to each sample as 60 Hz (that is, in such a way that 3600 discharges per minute are carried out). Then, a wear volume (wherein a volume of the noble metal tip and melt portion before the test is subtracted from a volume of the noble metal tip and melt portion after the test) of the noble metal tip and melt portion accompanying the spark discharges is measured after 400 hours have elapsed. Results of the tests are shown in FIG. 6. Although a setting is commonly made in such a way that a spark discharge occurs by taking the center electrode to be negative and the ground electrode to be positive in order to suppress the wear of the noble metal tip, in the tests, it is made a condition that the noble metal tip and the like are more likely to wear by taking the center electrode to be positive and the ground electrode to be negative, as heretofore described.

As shown in FIG. 6, with the samples wherein $\alpha X$ is taken to be less than −15° and $\alpha X$ is taken to be more than 25°, the wear volume is more than 1.5 $mm^3$, and it is revealed that the samples are inferior in wear resistance. It is conceivable that this is because, as the melt portion assumes a form such that it thrusts excessively into the noble metal tip, in the initial stage of wear of the noble metal tip, the melt portion inferior in wear resistance to the noble metal tip is exposed to the spark discharge gap side.

As opposed to this, with samples configured in such a way as to satisfy $-15 \leqq \alpha X \leqq 25$, the wear volume is suppressed to less than 0.15 $mm^3$ despite a test condition under which the noble metal tip and the like are likely to wear, and it is found that the samples have superior wear resistance.

It can be said from the above test results that it is preferable to configure the melt portion in such a way as to satisfy $-15 \leqq \alpha X \leqq 25$ in order to improve wear resistance.

Next, spark plug samples wherein the angle $\beta X$ formed by the third straight line and fourth straight line is variously changed by changing the processing rate and irradiation angle while satisfying $-15 \alpha X \leqq 25$ are fabricated, and the heretofore described desktop spark test is carried out on each sample. Results of the tests are shown in FIG. 7.

Figure 7:
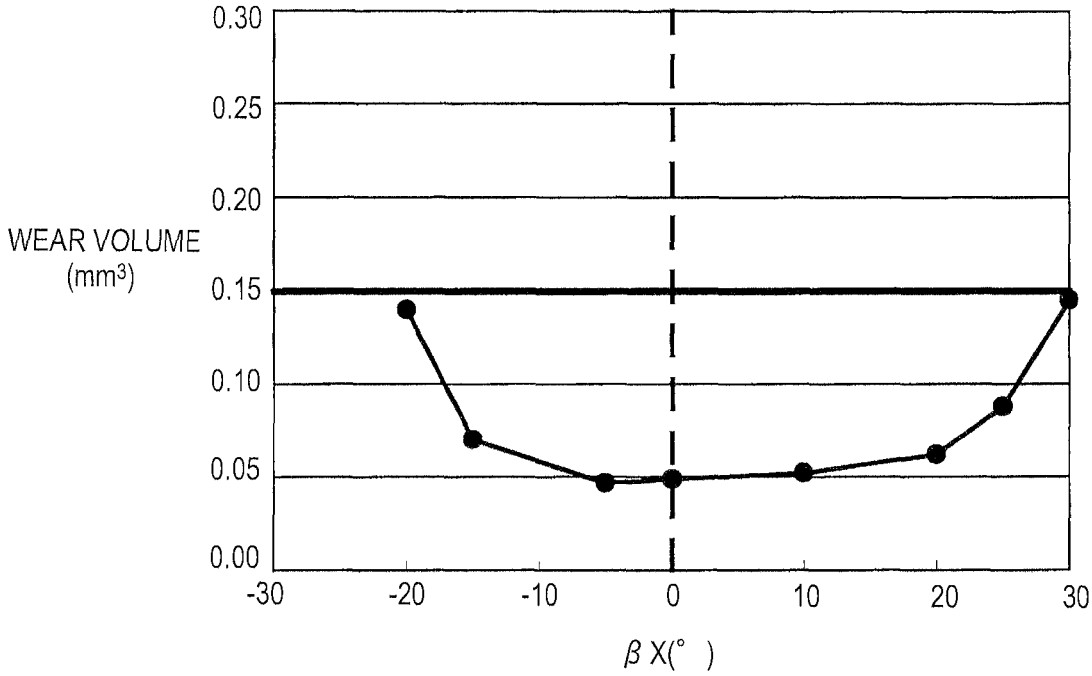
FIG. 7 is a graph showing a relationship between an angle βX and wear volume in the desktop spark test.

As shown in FIG. 7, each sample has superior wear resistance but, particularly with the samples satisfying $-15 \leqq \beta X \leqq 25$, the wear volume is less than 0.10 $mm^3$, and it is confirmed that the samples have very superior wear resistance.

It can be said from the above test results that, in order to further improve wear resistance, it is preferable to configure the melt portion in such a way as to satisfy $-15 \leqq \beta X \leqq 25$.

Figure 8:
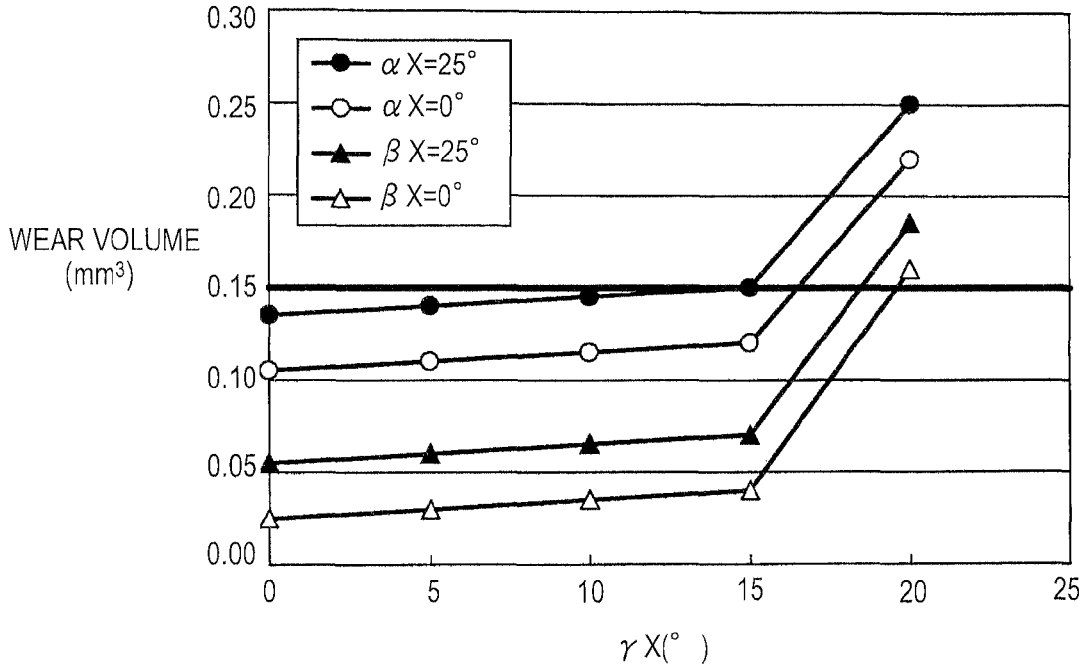
FIG. 8 is a graph showing a relationship between an angle γX and wear volume in a durability evaluation test.

Next, spark plug samples wherein the angle $\gamma X$ formed by the first straight line and third straight line is changed by variously changing the angle $\beta X$ after fixing the angle $\alpha X$ to 0° and 25°, and spark plug samples wherein the angle $\gamma X$ is changed by changing the angle $\alpha X$ after fixing the angle $\beta X$ to 0° and 25°, are fabricated, and a durability evaluation test is carried out on each sample. The outline of the durability evaluation test is as follows. That is, after mounting each sample in a four cylinder engine of 2000 cc displacement, a target temperature at which the ground electrode leading end portion is maintained is taken to be 750° C., and the engine is operated on all the cylinders (rotation amount=6000 rmp) for 400 hours. Then, after 400 hours have elapsed, the wear volume of the noble metal tip and melt portion in each sample is measured. Results of the tests are shown in FIG. 8. In the durability evaluation test, as each sample is discharged under high temperature, wear is more likely to occur in the noble metal tip and the like than in the heretofore described desktop spark test. Also, in FIG. 8, the test results of the samples wherein $\alpha X$ is taken to be 25° are indicated by the black circle, and the test results of the samples wherein $\alpha X$ is taken to be 0° are indicated by the white circle. Furthermore, the test results of the samples wherein $\beta X$ is taken to be 25° are indicated by the black triangle, and the test results of the samples wherein $\beta X$ is taken to be 0° are indicated by the white triangle.

As shown in FIG. 8, with the samples wherein $\gamma X$ is taken to be 15° or less, the wear volume is 0.15 $mm^3$ or less despite a test condition under which the noble metal tip and the like are very likely to wear, and it is revealed that the samples are very superior in wear resistance. It is conceivable that this is because, as the portion of the melt portion in contact with the noble metal tip is formed to be approximately flat, and the thrust of the melt portion into the noble metal tip is suppressed as much as possible, it is possible to effectively suppress the exposure of the melt portion to the spark discharge gap side.

It can be said from the above test results that, in order to further improve wear resistance, it is preferable to configure the melt portion in such a way as to satisfy $\gamma X \leqq 15$.

The invention, not being limited to the contents described in the heretofore described embodiments, may be implemented in, for example, the following ways. It goes without saying that other application examples and modification examples which are not illustrated below are also possible as a matter of course.

Figure 9:
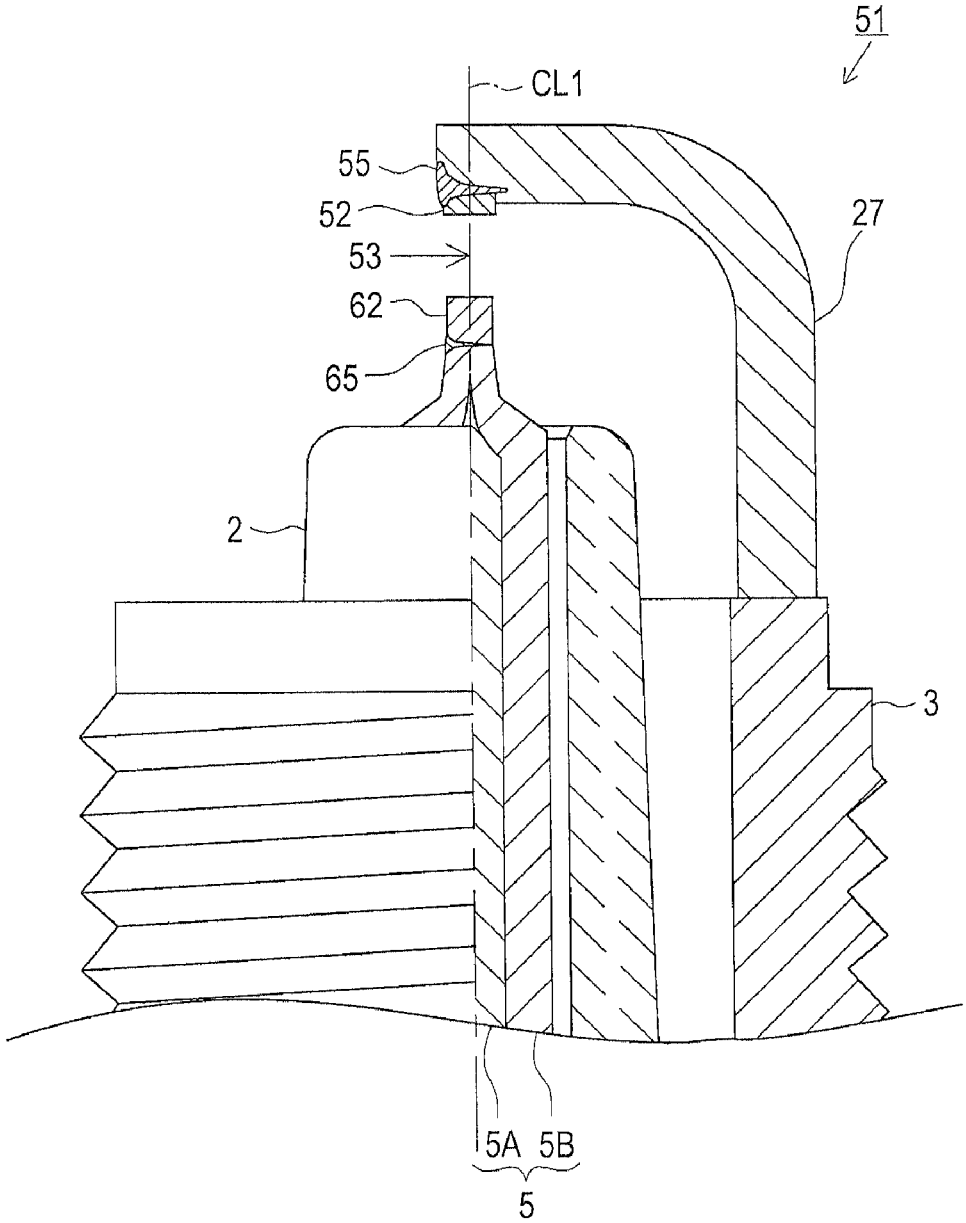
FIG. 9 is a partially sectioned enlarged front view showing a configuration of the leading end portion of a spark plug in another embodiment.

(a) In the heretofore described embodiments, the noble metal tip 32 (42) is joined to either one of the ground electrode 27 and center electrode 5 via the melt portion 35 (45), but as shown in FIG. 9, it may be taken that noble metal tips 52 and 62 are joined to both the ground electrode 27 and center electrode 5 respectively via melt portions 55 and 65 having the same configurations as in the heretofore described embodiments. In this case, as well as it being possible to realize superior detachment resistance in both the noble metal tips 52 and 62, it is possible to still further improve wear resistance. As a result of this, it is possible to still further suppress an increase of a spark discharge gap 53 accompanying a spark discharge, enabling a spark discharge over a longer period.

Figure 10:
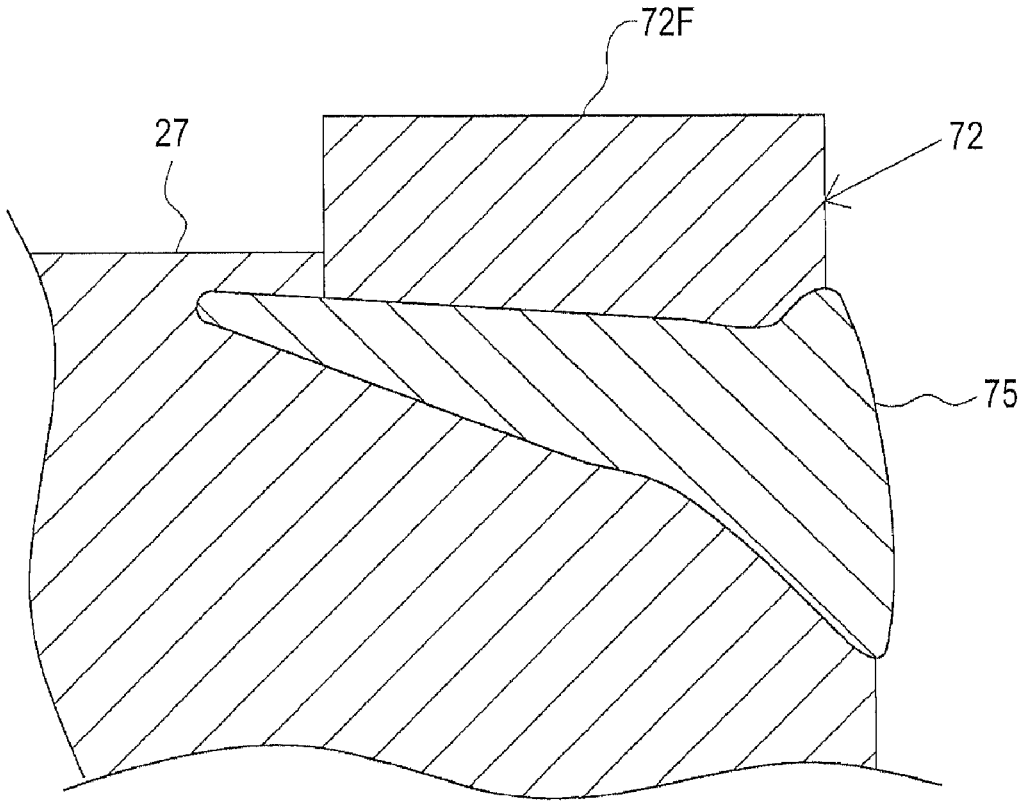
FIG. 10 is a partial enlarged sectional view showing a configuration of a melt portion in another embodiment.

(b) In the heretofore described embodiments, the laser beam or the like is caused to radiate in the orientation parallel to the other end face 32F of the noble metal tip 32, but the direction of irradiation with the laser beam or the like is not limited to this. Consequently, as shown in FIG. 10, it may be taken that the laser beam or the like is caused to radiate in a direction inclined to the ground electrode 27 side with respect to another end face 72F of a noble metal tip 72. In this case, a region of a formed melt portion 75 in contact with the noble metal tip 72 becomes more nearly parallel to the other end face 72F of the noble metal tip 72, and particularly a region of the noble metal tip 72 on the side irradiated with the laser beam or the like is formed to be thicker. Because of this, it is possible to further improve wear resistance.

Figure 11:
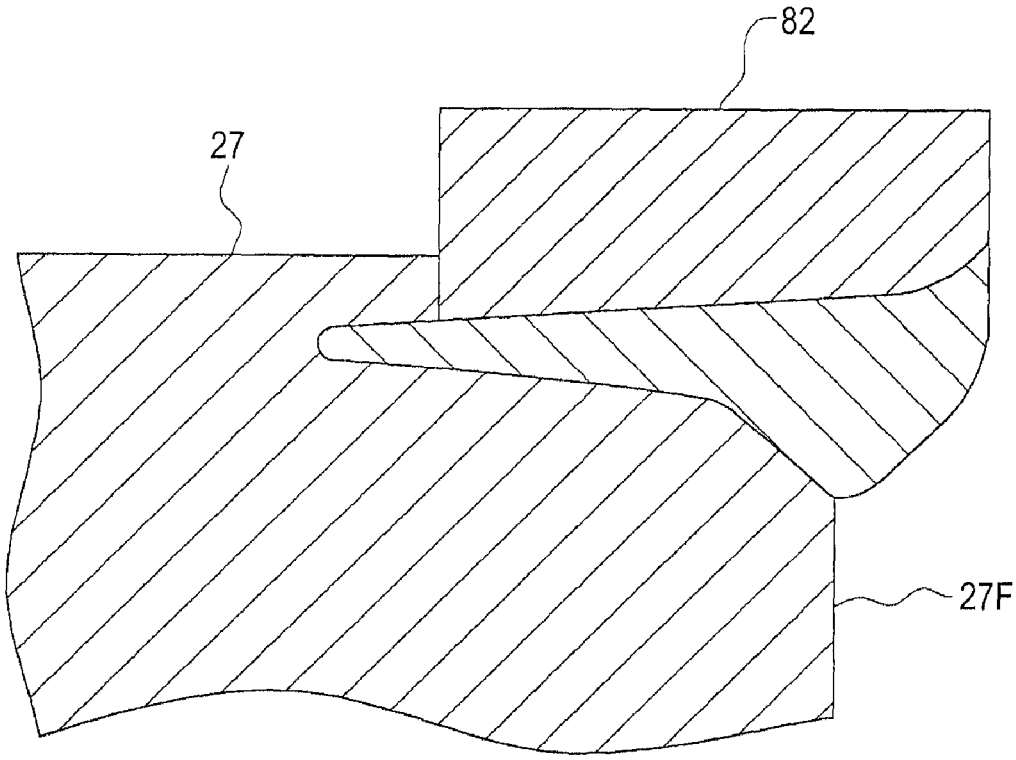
FIG. 11 is a partial enlarged sectional view showing a configuration of a noble metal tip and the like in another embodiment.

(c) The relative position between the ground electrode 27 and noble metal tip 32 in the first embodiment is one example and, for example, as shown in FIG. 11, it may be taken that a noble metal tip 82 is provided in such a way that one portion of the noble metal tip 82 protrudes from the leading end face 27F of the ground electrode 27. In this case, it is possible to effectively suppress a flame kernel growth inhibition caused by the ground electrode 27, and it is possible to improve ignitability.

Figure 12:
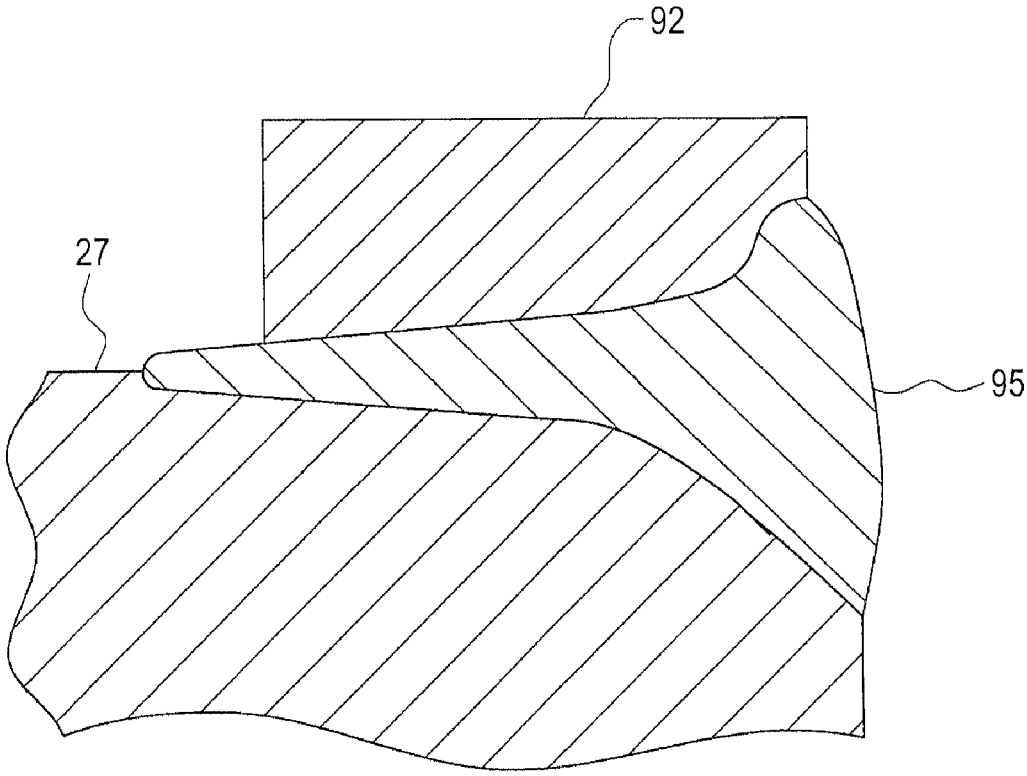
FIG. 12 is a partial enlarged sectional view showing a configuration of a noble metal tip and the like in another embodiment.

(d) In the heretofore described embodiments, the condition is attained in which one portion of the noble metal tip 32 is buried in the ground electrode 27, but as shown in FIG. 12, it may be taken that, by forming a melt portion 95 in a condition in which a noble metal tip 92 is placed on a side surface of the ground electrode 27, the noble metal tip 92 and ground electrode 27 are joined without the noble metal tip 92 being buried in the ground electrode 27.

Figure 13:
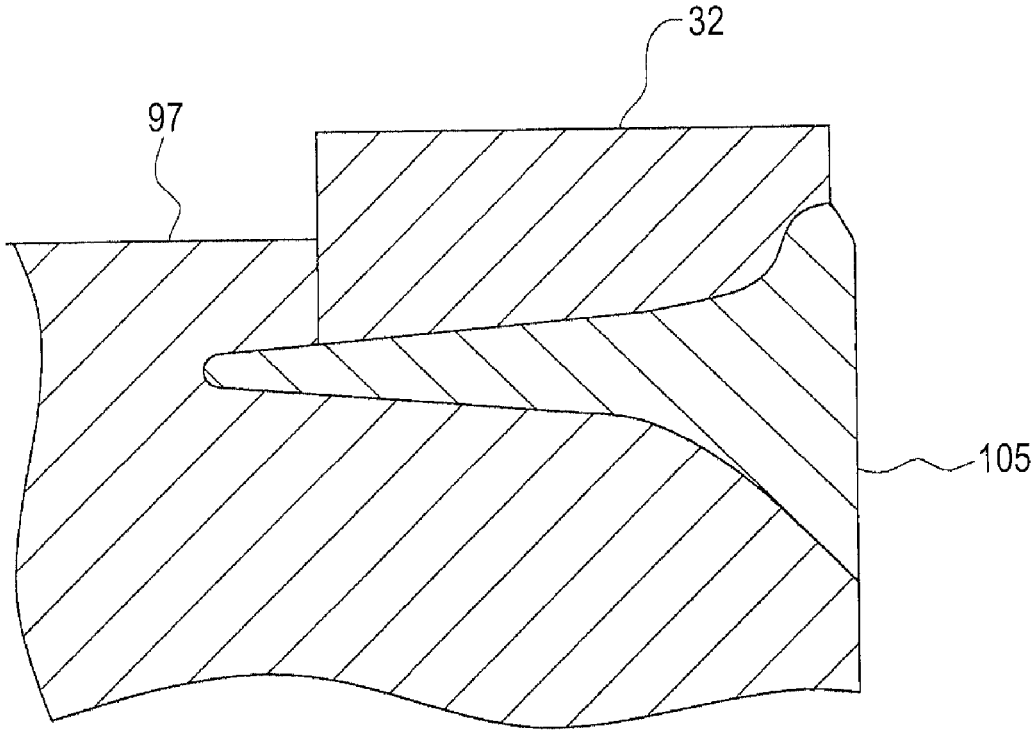
FIG. 13 is a partial enlarged sectional view showing a configuration of a ground electrode and the like in another embodiment.

(e) In the first embodiment, after the bonding of the noble metal tip 32 to the ground electrode 27, no particular process is performed on the ground electrode 27 or noble metal tip 32 except the process of bending the ground electrode 27, but as shown in FIG. 13, it may be taken that, after a step of joining the noble metal tip 32 to a ground electrode 97, a melt portion 105 and the ground electrode 97 are cut on the side irradiated with the laser beam or electron beam. In this case, it is possible to reduce the amount of the ground electrode 97 leading end portion protruding with respect to the noble metal tip 32, and it is possible to effectively suppress a flame kernel growth inhibition caused by the ground electrode 97. As a result of this, it is possible to further improve ignitability.

Figure 14:
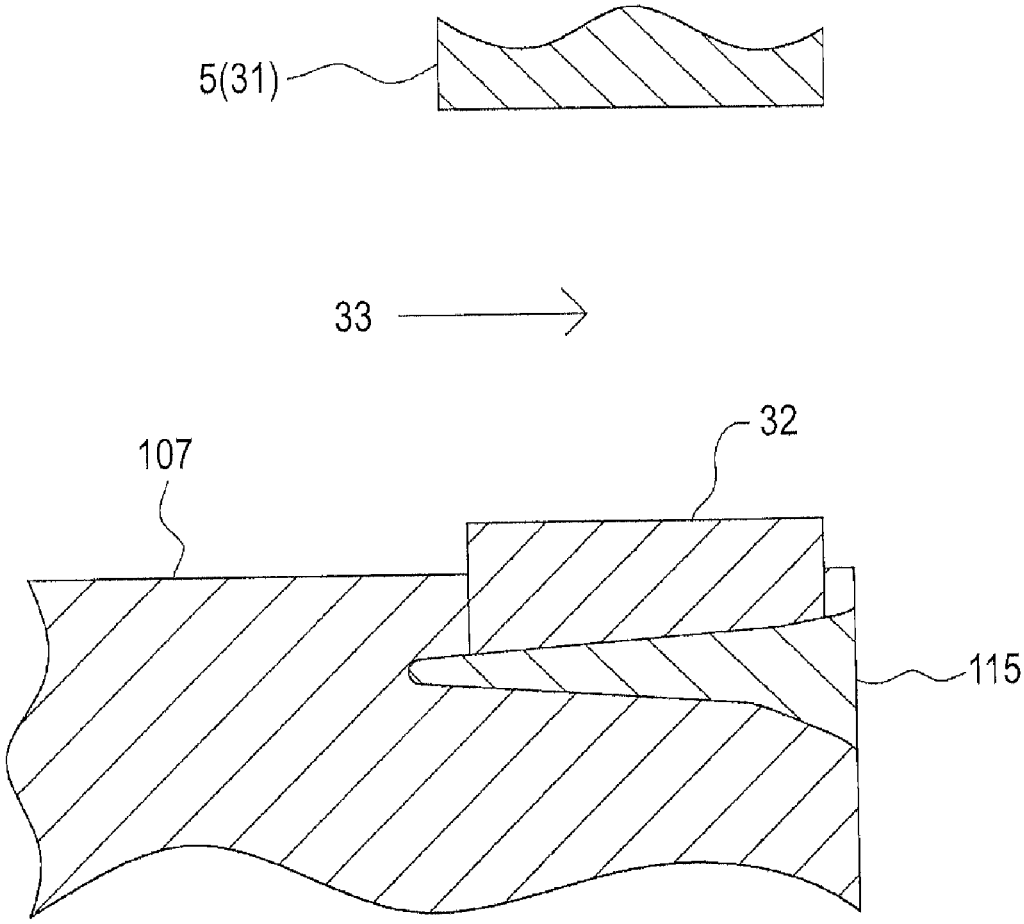
FIG. 14 is a partial enlarged sectional view showing a configuration of a ground electrode and the like in another embodiment.

Also, as shown in FIG. 14, it may be taken that, by cutting a melt portion 115 and ground electrode 107, the melt portion 115 is configured so as not to be exposed to the spark discharge gap 33 side. In this case, it is possible to suppress an occurrence of a spark discharge between the center electrode 5 and melt portion 115, and it is possible to further improve ignitability and wear resistance.

Figure 15:
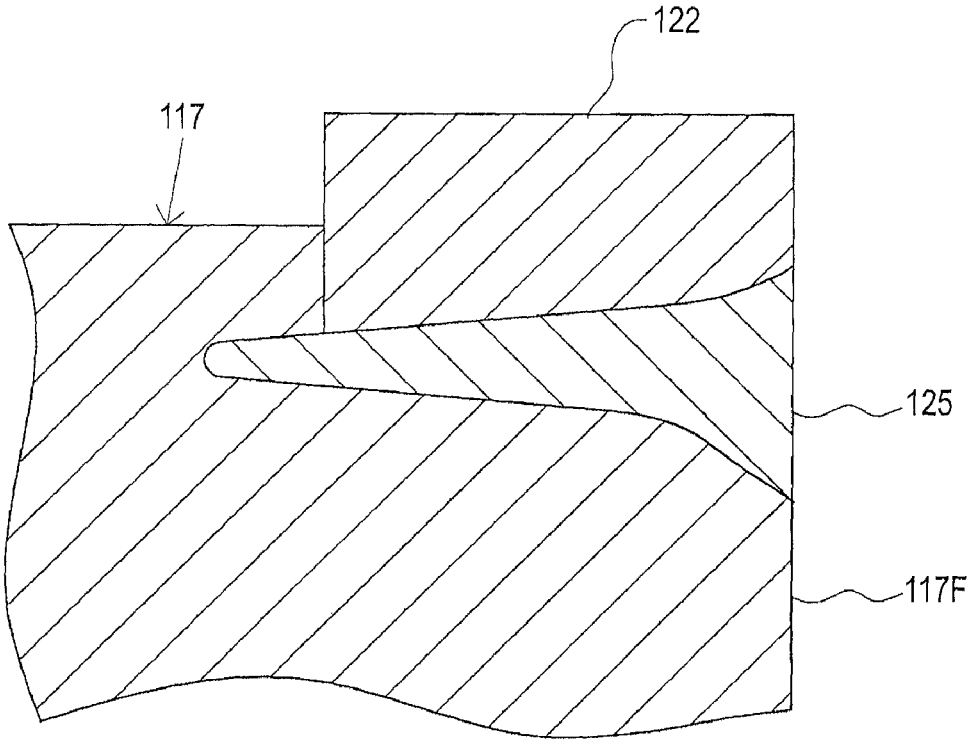
FIG. 15 is a partial enlarged sectional view showing a configuration of a noble metal tip and the like in another embodiment.

Furthermore, as shown in FIG. 15, it may be taken that, in the cutting step, by cutting a noble metal tip 122 in addition to a melt portion 125 and ground electrode 117, a side surface of the noble metal tip 122 and a leading end face 117F of the ground electrode 117 are formed flush. In this case, it is possible to more effectively suppress a flame kernel growth inhibition caused by the ground electrode 117. Also, it is possible to remove a comparatively thin-walled region of the noble metal tip 122 in the cutting step, and it is possible to reduce the angle $\alpha X$ and angle $\beta X$ closer to 0°. Consequently, it is possible to provide the noble metal tip 122 with a uniform thickness as a whole, and it is possible to further suppress an exposure of the melt portion 125 to the spark discharge gap 33 side. As a result of this, it is possible to further improve wear resistance.

Taking operability into account, it is preferable to carry out the cutting of the ground electrode and the like before the process of bending the ground electrode.

Figure 16:
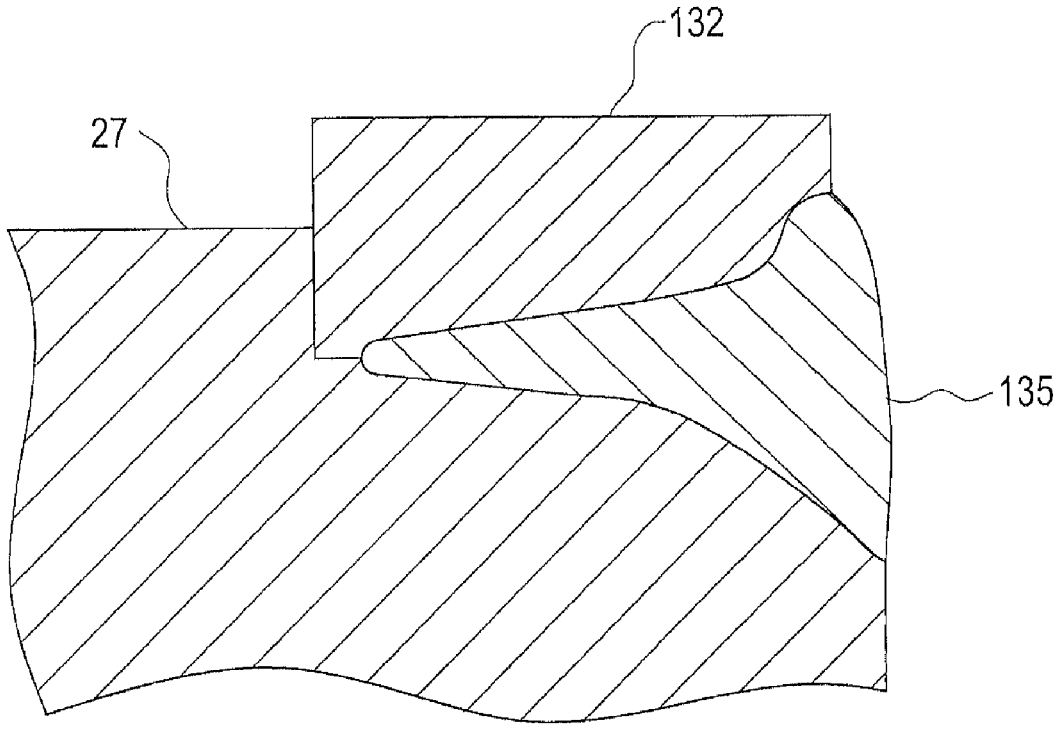
FIG. 16 is a partial enlarged sectional view showing a configuration of a melt portion in another embodiment.

(f) In the first embodiment, the whole region of the one end face of the noble metal tip 32 is joined to the ground electrode 27, but there is no need to join the whole region of the one end face of the noble metal tip 32 to the ground electrode, and as shown in FIG. 16, it is sufficient that a melt portion 135 is formed in such a way that ¾ or more of one end face of a noble metal tip 132 is joined to the ground electrode 27. Also, in the second embodiment, the whole region of the one end face of the noble metal tip 42 is joined to the center electrode 5, but it is sufficient that ¾ or more of the one end face of the noble metal tip 42 is joined to the center electrode 5.

Figure 17:
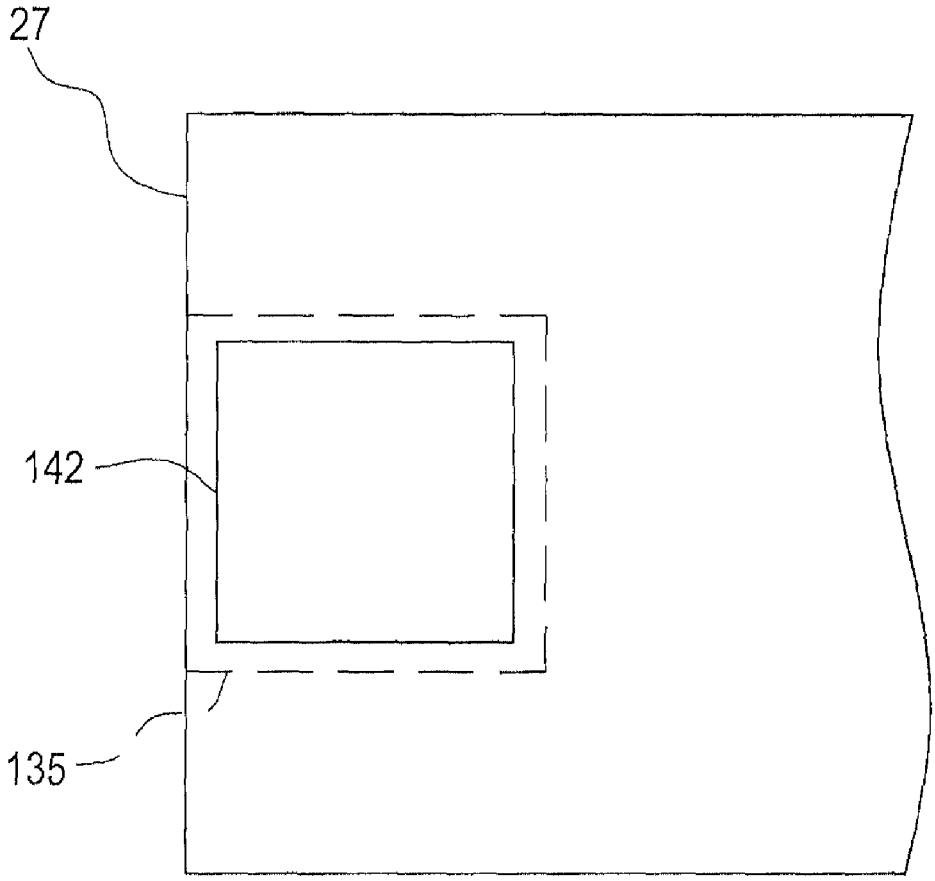
FIG. 17 is a partial enlarged plan view showing a configuration of a noble metal tip in another embodiment.

(g) In the heretofore described embodiments, the noble metal tip 32 (42) forms a cylindrical shape, but the shape of the noble metal tip is not limited to this. Consequently, as shown in FIG. 17, it may be taken that a noble metal tip 142 is formed into a quadrangular prism.

Figure 18:
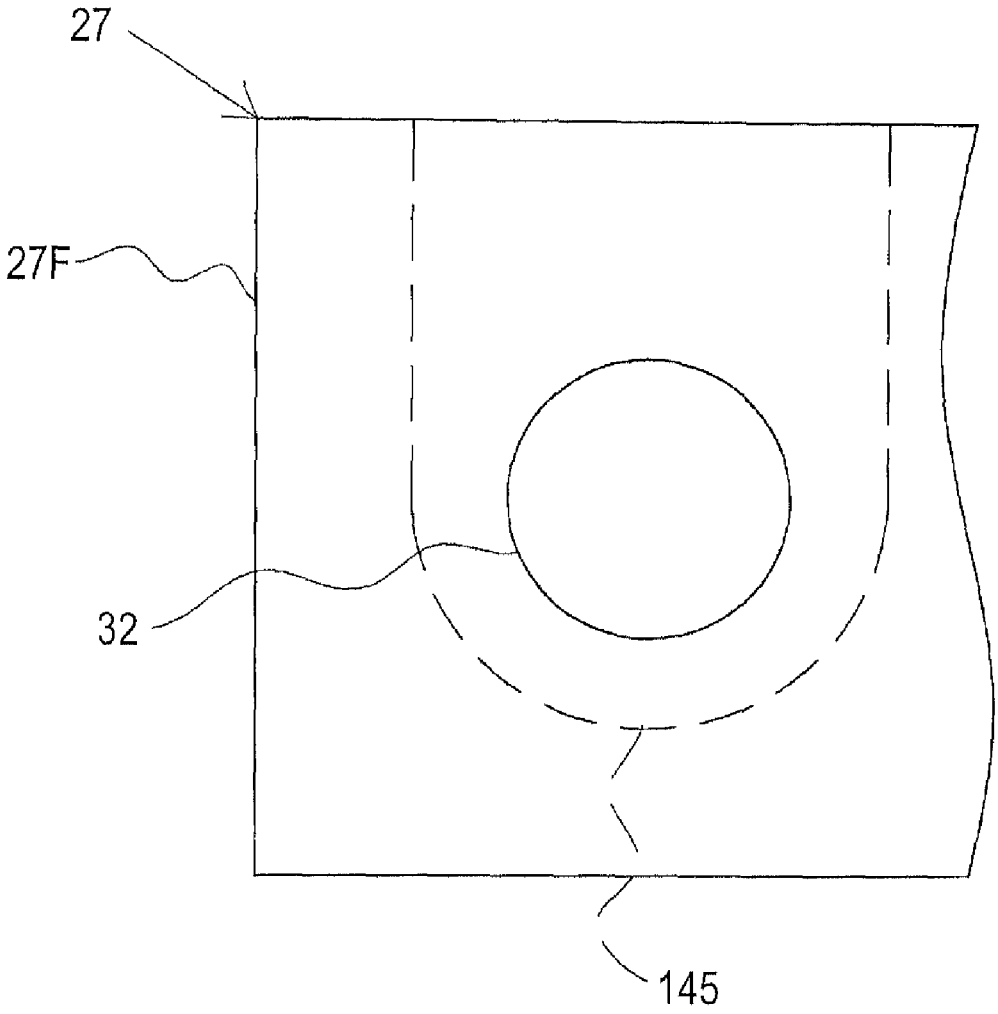
FIG. 18 is a partial enlarged plan view showing a configuration of a melt portion in another embodiment.

(h) In the first embodiment, the laser beam or the like is caused to radiate from the leading end face 27F side of the ground electrode 27, but as shown in FIG. 18, it may be taken that a melt portion 145 extending in a width direction of the ground electrode 27 is formed by being irradiated with the laser beam or the like from a side surface side adjacent to the leading end face 27F of the ground electrode 27, thereby joining the noble metal tip 32 to the ground electrode 27. Also, it may be taken that, after the bonding of the noble metal tip 32, the melt portion 145 and ground electrode 27 are cut on the side irradiated with the laser beam or the like, reducing the width of the ground electrode 27. In this case, a flame kernel growth inhibition caused by the ground electrode 27 is suppressed in the same way as in the heretofore described (e), and it is possible to improve ignitability.

Figure 19:
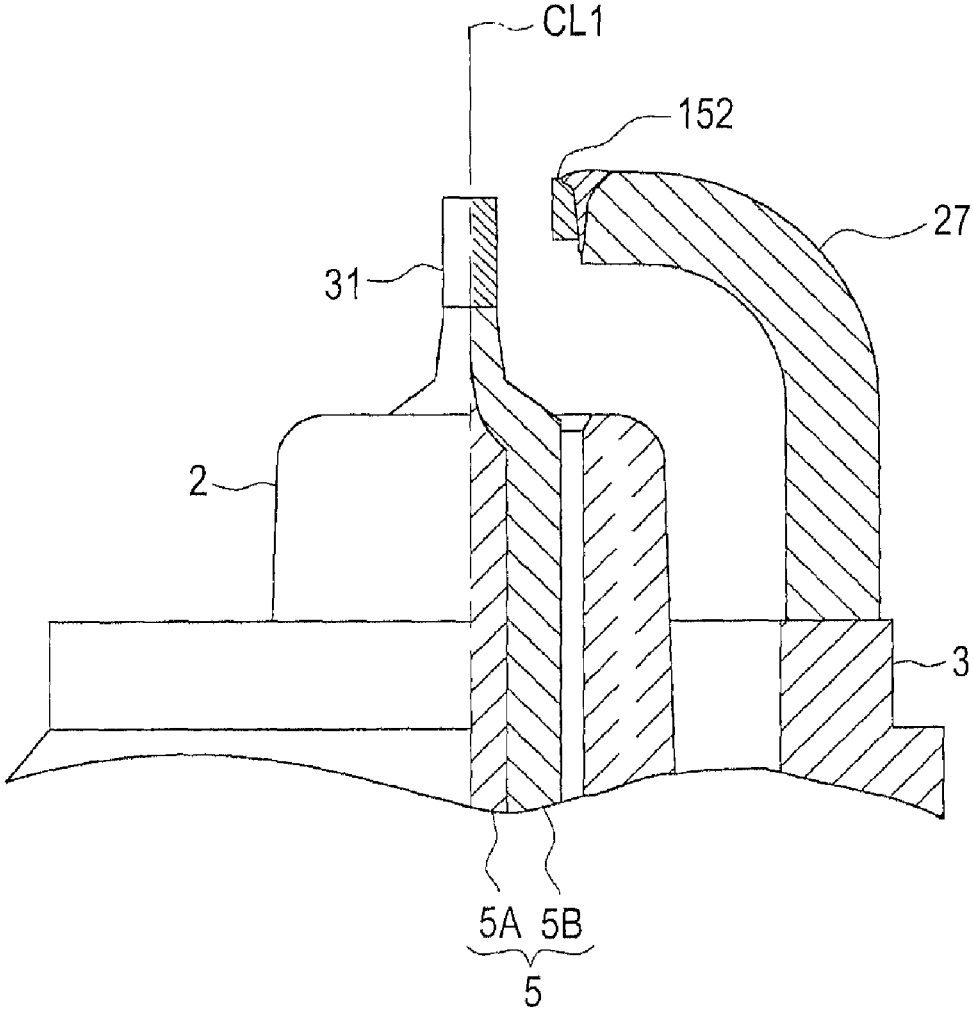
FIG. 19 is a partially sectioned enlarged front view showing a configuration of the leading end portion of a spark plug in another embodiment.

(i) In the first embodiment, the noble metal tip 32 is joined to the side surface of the ground electrode 27 on the center electrode 5 side, but as shown in FIG. 19, it may be taken that a noble metal tip 152 is joined to the leading end face of the ground electrode 27, and a configuration is such that a spark discharge between the noble metal tip 152 and center electrode (noble metal portion 31) is carried out approximately in a direction perpendicular to the axis CL1.

(j) In the heretofore described embodiments, the ground electrode 27 is configured of a single alloy, but it may be taken that an inner layer formed from copper, a copper alloy, or the like, superior in good heat conductance is provided inside the ground electrode 27, and the ground electrode 27 is configured as a multi-layer structure formed of an outer layer and inner layer.

(k) In the heretofore described embodiments, a case is embodied in which the ground electrode 27 is joined to the leading end portion 26 of the metal shell 3, but the invention can be applied to a case in which a ground electrode is formed in such a way as to cut out one portion of the metal shell (or one portion of a leading end fitting welded to the metal shell in advance) (for example, JP-A-2006-236906).

(l) In the heretofore described embodiments, the tool engagement portion 19 is formed to be of hexagonal cross section, but the shape of the tool engagement portion 19 is not limited to this kind of shape. The tool engagement portion 19 may be formed in, for example, a Bi-HEX (variant dodecagonal) shape [ISO22977:2005(E)].

1, 41 . . . Spark plug
2 . . . Insulator (insulating body)
3 . . . metal shell
4 . . . Axial hole
5 . . . Center electrode
27 . . . Ground electrode
32, 42 . . . Noble metal tip
32F, 42F . . . Another end face (of noble metal tip)
33, 43 . . . Spark discharge gap (gap)
35, 45 . . . Melt portion
35E, 45E . . . Exposed surface
CL1 . . . Axis
CL2, CL3 . . . Central axis (of noble metal tip)
L1 . . . First straight line
L2 . . . Second straight line
L3 . . . Third straight line
L4 . . . Fourth straight line
L5 . . . Fifth straight line
L6 . . . Sixth straight line
L7 . . . Seventh straight line
L8 . . . Eighth straight line

The invention claimed is:

1. A spark plug comprising:
a cylindrical insulating body having an axial hole extending in an axial direction;
a center electrode inserted in the axial hole;
a cylindrical metal shell provided on the outer periphery of the insulating body;
a ground electrode disposed at the leading end portion of the metal shell; and
a columnar noble metal tip of which one end face is joined to the leading end portion of the ground electrode, and the other end face forms a gap with the leading end portion of the center electrode, wherein
the noble metal tip is joined to the ground electrode via a melt portion, wherein the noble metal tip and ground electrode melt together, formed by being irradiated with a laser beam or electron beam from a side surface side of the noble metal tip, and
the melt portion, including an exposed surface which, being a region on the side irradiated with the laser beam or electron beam, is exposed on a surface of the ground electrode, is such that
in a section including a central axis of the noble metal tip and perpendicular to a side surface of the ground electrode on the side irradiated with the laser beam or electron beam,
¾ or more of the one end face of the noble metal tip being joined to the ground electrode and,
when the thickness of a thickest portion of the melt portion in a direction of the central axis of the noble metal tip is taken to be TX (mm), and the length of a longest portion of the melt portion in a direction of irradiation with the laser beam or electron beam is taken to be LX (mm), TX and LX satisfy $1.5 \leqq LX/TX$, and
when a first straight line is drawn passing through a point AX, on the boundary between the melt portion and noble metal tip, positioned between the external line of one side surface of the noble metal tip positioned on the exposed surface side and the central axis of the noble metal tip, and a point BX thereon positioned between the external line of the other side surface of the noble metal tip and the central axis of the noble metal tip,
a second straight line is drawn passing through the point BX and extending along the external line of the other end face of the noble metal tip, and
an acute angle $\alpha X$ (°) among angles formed by the first straight line and second straight line is taken to be positive when formed on the noble metal tip side, and taken to be negative when formed on the ground electrode side, with the second straight line as a reference,
the angle $\alpha X$ satisfies $-15 \leqq \alpha X \leqq 25$.

2. The spark plug according to claim 1, wherein
the whole region of the one end face of the noble metal tip being joined to the ground electrode and,
in the section including the central axis of the noble metal tip and perpendicular to the side surface of the ground electrode on the side irradiated with the laser beam or electron beam,
when a third straight line is drawn passing through a point CX, on the boundary between the melt portion and noble metal tip, intersecting the external line of the one side surface of the noble metal tip and a point DX thereon intersecting the external line of the other side surface of the noble metal tip,
a fourth straight line is drawn passing through the point DX and extending along the external line of the other end face of the noble metal tip, and
an acute angle $\beta X$ (°) among angles formed by the third straight line and fourth straight line is taken to be positive when formed on the noble metal tip side, and taken to be negative when formed on the ground electrode side, with the fourth straight line as a reference,
the angle $\beta X$ satisfies $-15 \leqq \beta X \leqq 25$.

3. The spark plug according to claim 2, wherein
an acute angle $\gamma X$, among angles formed by the first straight line and third straight line, is taken to be 15° or less.

4. A manufacturing method of the spark plug according to claim 1, wherein
a bonding step of joining the noble metal tip to the ground electrode by their being irradiated with a laser beam or electron beam to form the melt portion; and
a cutting step of cutting the melt portion and ground electrode on the side irradiated with the laser beam or electron beam after the bonding step.

5. The spark plug manufacturing method according to claim 4, wherein
in the cutting step, the melt portion, ground electrode, and noble metal tip are cut on the side irradiated with the laser beam or electron beam.

6. A spark plug comprising:
a cylindrical insulating body having an axial hole extending in an axial direction;

a center electrode inserted in the axial hole;

a cylindrical metal shell provided on the outer periphery of the insulating body; and a columnar noble metal tip of which one end face is joined to the leading end portion of the center electrode, wherein the noble metal tip is joined to the center electrode via a melt portion, wherein the noble metal tip and center electrode melt together, formed by being irradiated with a laser beam or electron beam from a side surface side of the noble metal tip, and the melt portion, including an exposed surface which, being a region on the side irradiated with the laser beam or electron beam, is exposed on a surface of the center electrode, is such that in a section including a central axis of the noble metal tip and passing through the center of the exposed surface, ¾ or more of the one end face of the noble metal tip being joined to the center electrode and, when the thickness of a thickest portion of the melt portion in a direction of the central axis of the noble metal tip is taken to be TY (mm), and the length of a longest portion of the melt portion in a direction of irradiation with the laser beam or electron beam is taken to be LY (mm), TY and LY satisfy $1.5 \leqq LY/TY$, and when a fifth straight line is drawn passing through a point AY, on the boundary between the melt portion and noble metal tip, positioned between the external line of one side surface of the noble metal tip positioned on the exposed surface side and the central axis of the noble metal tip, and a point BY thereon positioned between the external line of the other side surface of the noble metal tip and the central axis of the noble metal tip, a sixth straight line is drawn passing through the point BY and extending along the external line of the other end face of the noble metal tip, and an acute angle $\alpha Y$ (°) among angles formed by the fifth straight line and sixth straight line is taken to be positive when formed on the noble metal tip side, and taken to be negative when formed on the center electrode side, with the sixth straight line as a reference, the angle $\alpha Y$ satisfies $-15 \leqq \alpha Y \leqq 25$.

7. The spark plug according to claim 6, wherein the whole region of the one end face of the noble metal tip being joined to the center electrode and, in the section including the central axis of the noble metal tip and passing through the center of the exposed surface, when a seventh straight line is drawn passing through a point CY, on the boundary between the melt portion and noble metal tip, intersecting the external line of the one side surface of the noble metal tip and a point DY thereon intersecting the external line of the other side surface of the noble metal tip, an eighth straight line is drawn passing through the point DY and extending along the other end face of the noble metal tip, and an acute angle $\beta Y$ (°) among angles formed by the seventh straight line and eighth straight line is taken to be positive when formed on the noble metal tip side, and taken to be negative when formed on the center electrode side, with the eighth straight line as a reference, the angle $\beta Y$ satisfies $-15 \leqq \beta Y \leqq 25$.

8. The spark plug according to claim 7, wherein an acute angle $\gamma Y$, among angles formed by the fifth straight line and seventh straight line, is taken to be 15° or less.

9. A manufacturing method of the spark plug according to claim 2, wherein a bonding step of joining the noble metal tip to the ground electrode by their being irradiated with a laser beam or electron beam to form the melt portion; and a cutting step of cutting the melt portion and ground electrode on the side irradiated with the laser beam or electron beam after the bonding step.

10. A manufacturing method of the spark plug according to claim 3, wherein a bonding step of joining the noble metal tip to the ground electrode by their being irradiated with a laser beam or electron beam to form the melt portion; and a cutting step of cutting the melt portion and ground electrode on the side irradiated with the laser beam or electron beam after the bonding step.

* * * * *